US009931547B2

(12) United States Patent
Lacey et al.

(10) Patent No.: US 9,931,547 B2
(45) **Date of Patent: *Apr. 3, 2018**

(54) GOLF CLUB HEAD WITH A BODY-CONFORMING WEIGHT MEMBER

(71) Applicant: SRI SPORTS LIMITED, Kobe-shi, Hyogo (JP)

(72) Inventors: Sam G. Lacey, Park City, UT (US); Dan S. Nivanh, Long Beach, CA (US); Nathaniel J. Radcliffe, Huntington Beach, CA (US); Dustin J. Brekke, Fountain Valley, CA (US)

(73) Assignee: SRI SPORTS LIMITED, Kobe (JP)

( * ) Notice: Subject to any disclaimer, the term of this patent is extended or adjusted under 35 U.S.C. 154(b) by 909 days.

This patent is subject to a terminal disclaimer.

(21) Appl. No.: 14/305,992

(22) Filed: Jun. 16, 2014

(65) Prior Publication Data

US 2014/0295992 A1 Oct. 2, 2014

Related U.S. Application Data

(63) Continuation of application No. 13/178,261, filed on Jul. 7, 2011, now Pat. No. 8,784,234.

(Continued)

(51) Int. Cl.

| | |
|---|---|
| ***A63B 53/00*** | (2015.01) |
| ***A63B 53/04*** | (2015.01) |
| *A63B 60/00* | (2015.01) |

(52) U.S. Cl.

CPC .. *A63B 53/0466* (2013.01); *A63B 2053/0408* (2013.01); *A63B 2053/0412* (2013.01);

(Continued)

(58) Field of Classification Search

USPC ..... 473/345, 349, 350

See application file for complete search history.

(56) References Cited

U.S. PATENT DOCUMENTS 4,602,787 A 7/1986 Sugioka et al.
5,056,705 A * 10/1991 Wakita ..... A63B 53/04 164/76.1

(Continued)

FOREIGN PATENT DOCUMENTS

JP A-09-276451 10/1997
JP A-11-178958 7/1999

(Continued)

*Primary Examiner* — Gene Kim
*Assistant Examiner* — Matthew B Stanczak
(74) *Attorney, Agent, or Firm* — Oliff PLC

(57) ABSTRACT

A golf club head includes a main body having a top portion, a bottom portion, a striking face, and an interior surface. A weight member is coupled to the interior surface of the main body. In an imaginary vertical plane that passes through the weight member, the interior surface of the main body comprises a first point and a second point. An imaginary line passes through the first point and the second point. A first imaginary boundary line and a second imaginary boundary line, both passing through the weight member and being perpendicular to the imaginary line, pass through the first point and the second point, respectively. Between the first point and the second point, the interior surface of the main body has an irregularity factor of at least 1.2 and the weight member comprises a distribution factor of at most 1.0 and a conformity factor of at most 0.07.

31 Claims, 36 Drawing Sheets

Related U.S. Application Data

(60) Provisional application No. 61/368,017, filed on Jul. 27, 2010.

(52) U.S. Cl.
CPC ..... *A63B 2053/0433* (2013.01); *A63B 2053/0491* (2013.01); *A63B 2060/002* (2015.10); *A63B 2209/02* (2013.01)

(56) References Cited

U.S. PATENT DOCUMENTS 5,411,255 A 5/1995 Kurashima et al.
5,720,674 A 2/1998 Galy
5,851,159 A 12/1998 Burrows
5,851,160 A 12/1998 Rugge et al.
5,913,735 A 6/1999 Kenmi
5,971,867 A * 10/1999 Galy ..... A63B 53/04 473/334
6,048,278 A 4/2000 Meyer et al.
6,056,649 A 5/2000 Imai
6,162,132 A 12/2000 Yoneyama
6,206,789 B1 * 3/2001 Takeda ..... A63B 53/04 473/335
6,315,678 B1 * 11/2001 Teramoto ..... A63B 53/00 473/291
6,422,951 B1 7/2002 Burrows
6,565,452 B2 5/2003 Helmstetter et al.
6,604,568 B2 * 8/2003 Bliss ..... A63B 53/04 148/669
6,739,984 B1 5/2004 Ciasullo
6,945,877 B2 * 9/2005 Kobayashi ..... A63B 53/04 473/345
7,175,541 B2 * 2/2007 Lo ..... A63B 53/0466 273/DIG. 14
7,294,064 B2 11/2007 Tsurumaki et al.
7,318,782 B2 1/2008 Imamoto et al.
7,344,452 B2 3/2008 Imamoto et al.
7,347,795 B2 3/2008 Yamagishi et al.
7,396,296 B2 7/2008 Evans
7,438,647 B1 10/2008 Hocknell
7,438,649 B2 10/2008 Ezaki et al.
7,448,962 B2 11/2008 Kusumoto
7,455,597 B2 * 11/2008 Matsunaga ..... A63B 53/0466 473/329
7,520,822 B2 4/2009 Yamagishi et al.
7,524,249 B2 4/2009 Breier et al.
7,540,812 B2 6/2009 Imamoto et al.
7,578,756 B2 8/2009 Erickson et al.
7,658,687 B2 * 2/2010 Hirano ..... A63B 53/0466 473/345
7,758,452 B2 7/2010 Soracco
8,025,591 B2 * 9/2011 De La Cruz ..... A63B 53/0466 473/344
8,206,243 B2 * 6/2012 Stites ..... A63B 53/0466 473/334
8,333,668 B2 * 12/2012 De La Cruz ..... A63B 53/0466 473/345
2003/0220155 A1 * 11/2003 Nishitani ..... A63B 53/04 473/335
2003/0232663 A1 * 12/2003 Bliss ..... A63B 53/04 473/349
2004/0157678 A1 8/2004 Kohno
2004/0166960 A1 * 8/2004 Kobayashi ..... A63B 53/04 473/349
2004/0192463 A1 9/2004 Tsurumaki et al.
2005/0009626 A1 * 1/2005 Imamoto ..... A63B 53/047 473/338
2005/0159239 A1 7/2005 Imamoto et al.
2006/0019768 A1 * 1/2006 Lo ..... A63B 53/0466 473/345
2006/0019770 A1 1/2006 Meyer et al.
2006/0116218 A1 * 6/2006 Burnett ..... A63B 53/0466 473/349
2006/0287131 A1 * 12/2006 Hirano ..... A63B 53/0466 473/345
2007/0078028 A1 * 4/2007 Huang ..... A63B 53/0466 473/324
2007/0093316 A1 * 4/2007 Yamamoto ..... A63B 53/0466 473/345
2007/0129167 A1 6/2007 Matsunaga
2008/0081709 A1 * 4/2008 Hirano ..... A63B 53/0466 473/346
2009/0105010 A1 4/2009 De La Cruz et al.
2009/0258726 A1 * 10/2009 Abe ..... A63B 53/0466 473/345
2010/0151963 A1 * 6/2010 Meyer ..... A63B 53/0466 473/345
2010/0160075 A1 6/2010 Dawson et al.
2011/0021289 A1 1/2011 Yokota
2011/0053705 A1 3/2011 Stites
2012/0058839 A1 3/2012 De La Cruz et al.
2013/0035178 A1 2/2013 Roach et al.
2013/0102414 A1 * 4/2013 De la Cruz ..... A63B 53/0466 473/345

FOREIGN PATENT DOCUMENTS

JP A-2000-254260 9/2000
JP A-2001-000595 1/2001
JP A-2001-224713 8/2001
JP A-2002-177416 6/2002

* cited by examiner

A - A'

B – B'

A – A'

GOLF CLUB HEAD WITH A BODY-CONFORMING WEIGHT MEMBER

RELATED U.S. APPLICATIONS

This application is a Continuation of application Ser. No. 13/178,261, filed Jul. 7, 2011, which claims the benefit of Provisional Patent Application No. 61/368,017, filed Jul. 27, 2010. The prior applications, including the specifications, drawings and abstracts are incorporated herein by reference in their entirety.

COPYRIGHT AUTHORIZATION

The disclosure below may be subject to copyright protection. The copyright owner has no objection to the facsimile reproduction by anyone of the documents containing this disclosure, as they appear in the Patent and Trademark Office records, but otherwise reserves all applicable copyrights.

BACKGROUND

A common concern in golf club manufacturing is maximizing the ability to position mass in a desired location within a club head while maintaining the club head's structural integrity. A target mass is often selected corresponding to the desired total mass of a finished club head. The target mass may be a function of the expected maximum length of a shaft that may be assembled to the head and the selection of grips that may be fitted thereto. A minimum structural mass of a club head corresponds to the minimum mass of all structural components required to produce a club head having a desired shape that can withstand typical loads applied to the club head during use. The difference between the target mass and the minimum structural mass, i.e. discretionary mass, is often sought to be maximized.

Placement of discretionary mass is known to affect characteristics associated with the performance of the club head. For example, such placement affects the location of the center of gravity of the club head. Also, the location of discretionary mass about a club head affects the orientation of the principal axes of inertia passing through the center of gravity, and the moments and products of inertia about them.

Regarding the location of the center of gravity, it is known that a low (close to the bottom portion, or sole, of the club head) and deep (rearward from the face center of the striking face of the club head) center of gravity provides beneficial launch conditions at the moment of impact with a golf ball. Specifically, a low center of gravity increases launch angle and decreases ball spin, which increases carry and overall distance. A deeper center of gravity reduces backspin imparted to the golf ball at impact.

Because of golfers' increasing desire for club heads of larger volume, the concern for maximizing discretionary mass and optimizing its position is more significant. For example, increasing head volume while maintaining a traditional head shape reduces weight budget and, thus, the ability to improve performance of the club head.

Some attempts have been made to mitigate these concerns, but with mixed results. Golf club manufacturers have adapted thin-walled casting techniques for metal wood head portions such as the crown, sole, or skirt. Also, manufacturers have increasingly opted for materials having a specific strength (ultimate tensile strength divided by specific gravity) that is greater than conventional head materials such as steel or titanium, for certain portions of the club head.

However, these types of club heads are generally expensive to manufacture. Further, the acoustic properties of these club heads have been compromised. In addition, manufacturers have applied composite materials, e.g., carbon fiber reinforced epoxy or carbon fiber reinforced polymer, to form portions of the head. However, such heads have suffered from durability, performance, and manufacturing issues generally associated with composite materials.

SUMMARY

The object of the present invention is to provide a golf club head having a weight member configured to provide the club head with beneficial overall mass properties, such as a desirable center of gravity location and increased moment of inertia, to increase accuracy in assembly, and to reduce production cost.

In one or more aspects of the present invention, a golf club head oriented in a reference position comprises a main body having a heel, a toe, a top portion, a bottom portion, a striking face having a face center, a forward-most extent, a rearward-most extent, an interior surface, an exterior surface, a hosel, a peripheral edge, an overall club-head width measured in a heel-toe direction, an overall club-head length measured in a forward-rearward direction, and a geometric center. A discrete weight member is coupled to the interior surface of the main body. The weight member includes a density of at least about 3 g/cm$^3$, a projection area, in a top plan view, of at least about 2 cm$^2$, a first surface that is proximate the interior surface of the main body, and a second surface that is distal the interior surface of the main body. A majority of the mass of the weight member is located in a three-dimensional space, bounded, in a top plan view, between the peripheral edge and an imaginary inner boundary inwardly offset from the peripheral edge by a distance of 0.3 times the overall club head length. In an imaginary vertical plane that passes through the weight member, the interior surface of the main body comprises a first point and a second point, an imaginary line passes through the first point and the second point, a first imaginary boundary line perpendicular to the imaginary line and passing through the first point passes through the weight member, a second imaginary boundary line perpendicular to the imaginary line and passing through the second point passes through the weight member. Between the first point and the second point, the interior surface of the main body comprises an irregularity factor of at least 1.2. Between the first point and the second point, the weight member comprises a distribution factor of at most 1.0 and a conformity factor of at most 0.07.

In one or more aspects of the present invention, a golf club head oriented in a reference position comprises a main body having a heel, a toe, a top portion, a bottom portion, a striking face having a face center, a forward-most extent, a rearward-most extent, an interior surface, an exterior surface, a peripheral edge, a hosel, an overall club-head length measured in a forward-rearward direction; and an overall club-head width measured in a heel-toe direction. A discrete weight member is coupled to the interior surface of the main body. The weight member has a density of at least about 3 g/cm$^3$, a projection area, in a top plan view, of at least about 2 cm$^2$, a first surface proximate the interior surface of the main body, and a second surface distal the interior surface of the main body. A majority of the mass of the weight member is located in a three-dimensional space, bounded, in a top plan view, between the peripheral edge and an imaginary inner boundary inwardly offset from the peripheral edge by a distance of 0.3 times the overall club head length. In an imaginary vertical plane that passes through the weight member, the interior surface of the main body comprises a first point and a second point and an imaginary line passes through the first point and the second point. A first imaginary boundary line perpendicular to the imaginary line and passing through the first point passes through the weight member. A second imaginary boundary line perpendicular to the imaginary line and passing through the second point passes through the weight member. Between the first point and the second point, the weight member comprises a distribution factor of at most 1.0. Between the first point and the second point, the second surface of the weight member comprises a second-surface irregularity factor of at least 1.20. Between the first point and the second point, the interior surface of the main body comprises an interior-surface irregularity factor of at least 1.20. An intercomponent ratio of the second-surface irregularity factor to the interior-surface irregularity factor is between 0.70 and 1.3.

These and other features and advantages of the golf club head according to the invention in its various aspects, as demonstrated by one or more of the various examples, will become apparent after consideration of the ensuing description, the accompanying drawings, and the appended claims. The drawings described below are for illustrative purposes only and are not intended to limit the scope of the present invention.

BRIEF DESCRIPTION OF THE DRAWINGS

Exemplary implementations of the invention will now be described with reference to the accompanying drawings, wherein:

FIG. 1(*a*) is a front elevational view of an exemplary golf club head according to one or more aspects of the present invention.

FIG. 1(*b*) is a perspective view of the exemplary golf club head of FIG. 1(*a*), according to one or more aspects of the present invention.

FIG. 1(*c*) is a front elevational view of the exemplary golf club head of FIG. 1(*a*), wherein a template is applied to the front portion of the golf club head.

FIG. 12(*b*) is a cut-away perspective view of the exemplary golf club head of FIG. 12(*a*) according to one or more aspects of the present invention.

FIG. 12(*c*) is an exploded perspective view of the exemplary golf club head of FIG. 12(*a*) according to one or more aspects of the present invention.

FIG. 13(*b*) is a side sectional view of the exemplary golf club head of FIG. 13(*a*), through plane A-A', according to one or more aspects of the present invention.

FIG. 13(*c*) is a side sectional view of a section of the cross-section shown in FIG. 13(*b*).

FIG. 13(*d*) is a side sectional view of the section of FIG. 13(*c*) showing further detail.

FIG. 13(*e*) is a side sectional view of the section of FIG. 13(*c*) showing further detail.

FIG. 13(*f*) is a side sectional view of the section of FIG. 13(*c*) showing further detail.

FIG. 13(*g*) is a side sectional view of the section of FIG. 13(*c*) showing further detail.

FIG. 13(*h*) is a side sectional view of the section of FIG. 13(*c*) showing further detail.

FIG. 13(*i*) is a side sectional view of the exemplary golf club head of FIG. 13(*a*), through plane B-B' according to one or more aspects of the present invention.

FIG. 14(*b*) is a side sectional view of the exemplary golf club head of FIG. 14(*a*), through plane A-A' according to one or more aspects of the present invention.

FIG. 14(*c*) is a side sectional view of a segment of the cross-section of FIG. 14(*b*).

FIG. 14(*d*) is a side sectional view of the section of FIG. 14(*c*) showing further detail.

FIG. 14(*e*) is a side sectional view of the section of FIG. 14(*c*) showing further detail.

FIG. 14(*f*) is a side sectional view of the section of FIG. 14(*c*) showing further detail.

FIG. 14(*g*) is a side sectional view of the section of FIG. 14(*c*) showing further detail.

FIG. 18(*b*) is a side elevational view of the exemplary golf club head of FIG. 18(*a*).

FIG. 19(*b*) is a top plan view of an exemplary golf club head according to one or more aspects of the present invention.

FIG. 20(*b*) is a cutaway perspective view of the exemplary golf club head of FIG. 20(*a*) in a first assembly state according to one or more aspects of the present invention.

FIG. 20(*c*) is a cutaway perspective view of the exemplary golf club head of FIG. 20(*a*) in a second assembly state according to one or more aspects of the present invention.

FIG. 21(*b*) is a cutaway perspective view of the exemplary golf club head of FIG. 21(*a*) according to one or more aspects of the present invention.

FIG. 21(*c*) is a top plan view of the weight member of the exemplary golf club head of FIG. 21(*a*) according to one or more aspects of the present invention.

For the purposes of illustration these figures are not necessarily drawn to scale. In all of the figures, like components are designated by like reference numerals.

DETAILED DESCRIPTION

Examples of the golf club head according to one or more aspects of the invention will be described using one or more definitions, provided below.

Figure 1:
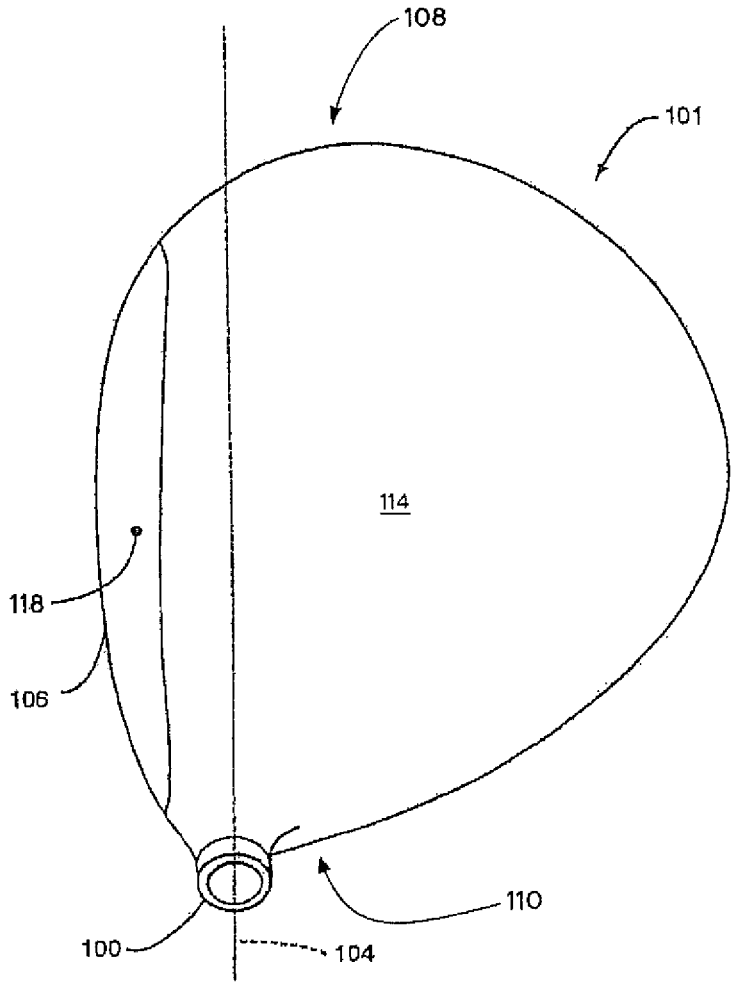
FIG. 1 is a top plan view of an exemplary golf club head according to one or more aspects of the present invention.
Figure 1A:
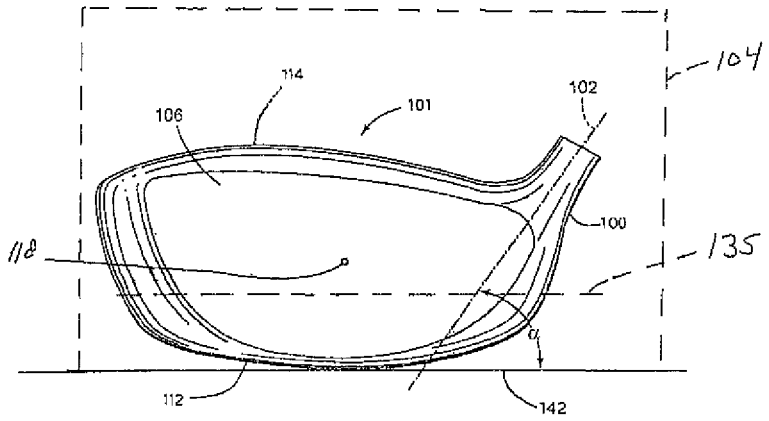
Figure 1B:
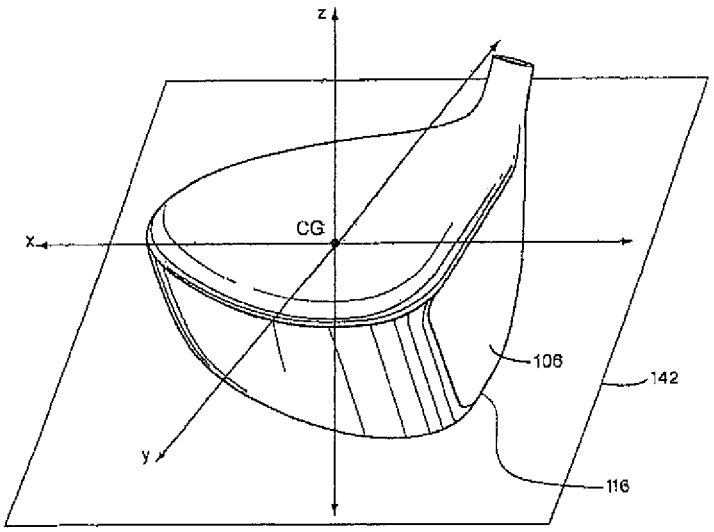
Figure 1C:
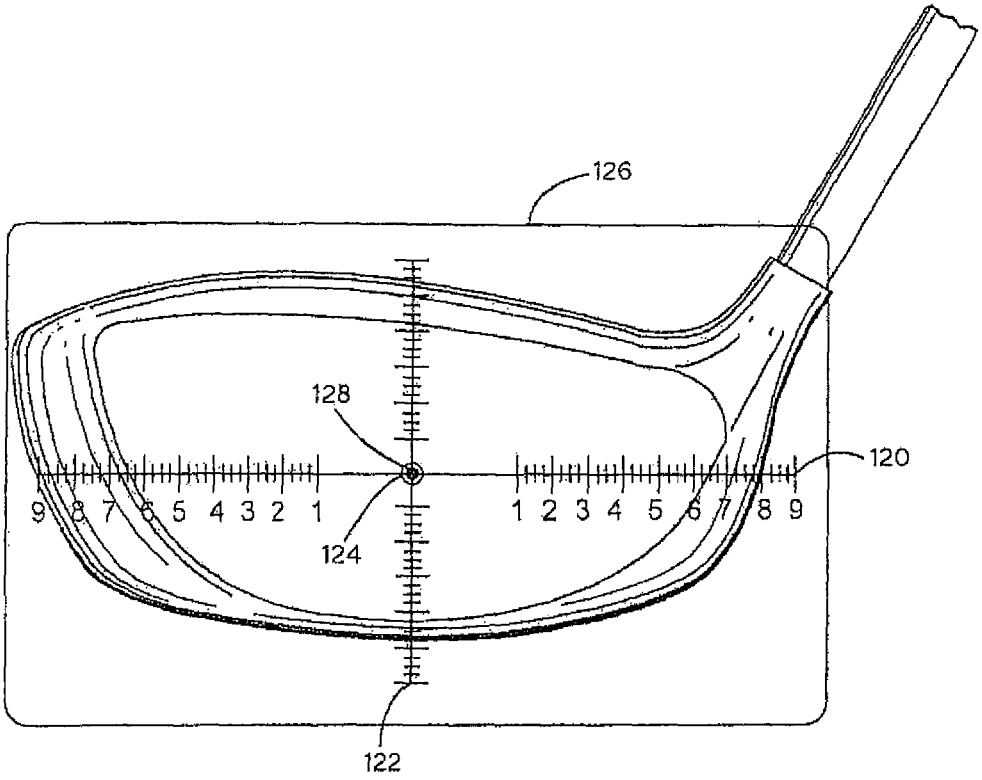

Referring to FIGS. 1-1(*c*), a golf club head 101, in one or more aspects of the present invention, includes a toe portion 108, a heel portion 110, a bottom portion 112, a top portion 114, a striking face 106 having a leading edge 116, and a hosel 100 for receiving a shaft (not shown). The hosel 100 has a hosel centerline 102 (see FIG. 1(*a*)). The striking face 106 may be integral with the club head 101 or joined thereto, e.g., by welding, brazing, adhesive bonding, or mechanical interlocking. The striking face 106 includes a face center 118.

Referring again to FIGS. 1(*a*)-1(*c*), "face center," e.g., the face center 118, as used herein, may be located using a template 126 having a coordinate system with a heel-toe axis 120 orthogonal to a top-bottom axis 122. An aperture 124 is located at the origin of the coordinate system and the axes are graduated into evenly spaced increments. The template 126 may be made of a flexible material, e.g., a transparent sheet polymer.

The location of the face center 118 is determined as follows. The template 126 is initially applied to the front surface 128 so that the aperture 124 is approximately in the middle of the striking face 106 and the heel-toe axis 120 is generally parallel to the line 135. The template 126 is then translated in the heel-toe direction along the striking face 106 until the heel and the toe measurements along the axis 120 at the opposite edge of the striking face 106 have the same absolute value. Once the template 126 is centered with respect to the striking face 106 in the heel-toe direction, the template 126 is translated in the top-bottom direction along the striking face 106 until the measurements along the axis 122 at the opposite edges of the striking face 106 have the same absolute value. The above sequence is repeated until the absolute value of the heel measurement along axis 120 is equal to that of the toe measurement and the absolute value of the bottom measurement along axis 122 is equal to that of the top measurement. A point is then marked on the front surface through the aperture 124 to designate the face center 118.

A locating template, such as the template 124, is referenced in the United States Golf Association's Procedure for Measuring the Flexibility of a Golf Clubhead (Revision 2.0, Mar. 25, 2005) and is available from the USGA.

Referring to FIGS. 1 and 1(*a*), the term "reference position," as used herein, denotes a club head position wherein a hosel 100 has a hosel centerline 102. As illustrated in FIG. 1(*a*), the hosel centerline 102 is oriented at a lie angle $\alpha$ of 60° with respect to a horizontal ground plane 142 and lies in an imaginary vertical hosel plane 104, which contains an imaginary horizontal line 135 generally parallel to the striking face 106. Unless otherwise indicated, all parameters are specified with the club head 101 in the reference position.

Referring to FIG. 1, "top portion", e.g., the top portion 114, as used herein, denotes the portion of the club head 101, excluding the striking face 106 and the hosel 100, visible in a top plan view with the club head 101 in the reference position.

Figure 2:
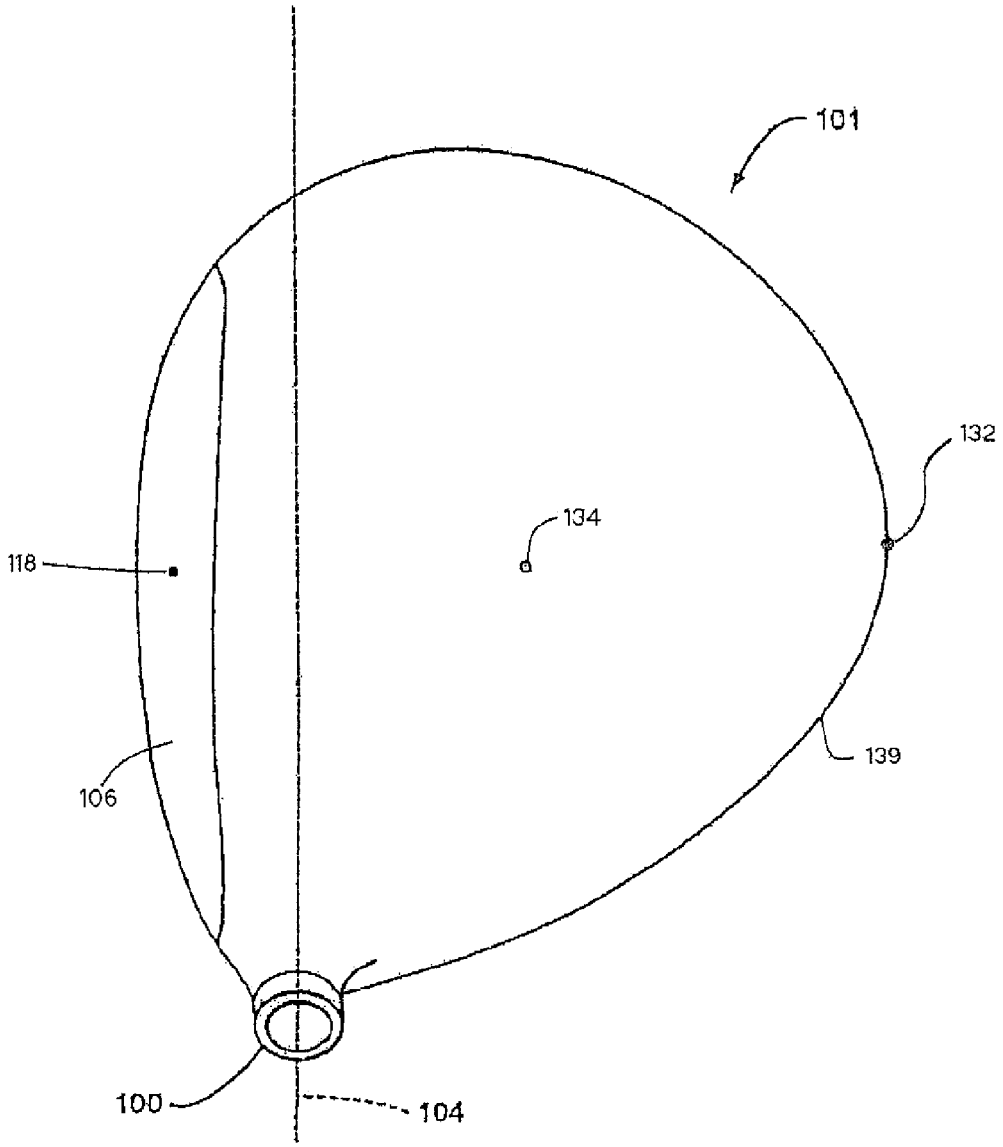
FIG. 2 is a top plan view of an exemplary golf club head according to one or more aspects of the present invention.

Referring to FIG. 2, "peripheral edge," e.g., a peripheral edge 139 of the golf club head 101, as used herein, denotes the perimetric boundary of the club head 101 in a top plan view.

Figure 3:
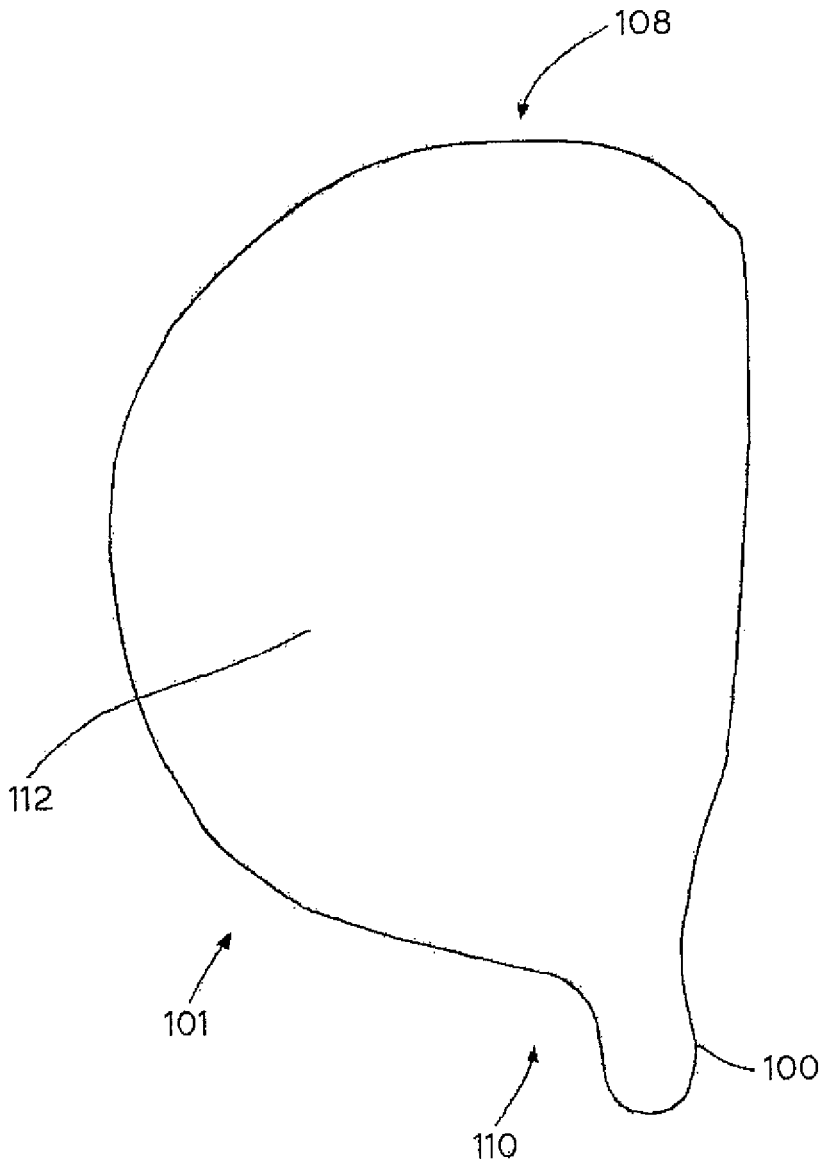
FIG. 3 is a bottom plan view of an exemplary golf club head according to one or more aspects of the present invention.

Referring to FIG. 3, "bottom portion", e.g., the bottom portion 112, as used herein, denotes the portion of the club head 101, excluding the hosel 100, visible in a bottom plan view with the club head 101 in the reference position.

Figure 4:
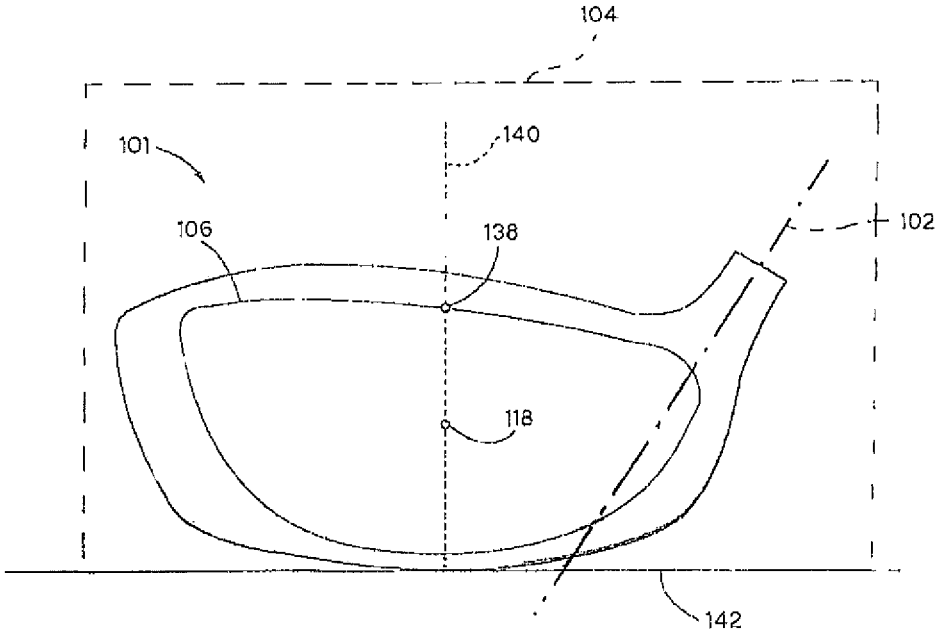
FIG. 4 is a front elevational view of an exemplary golf club head according to one or more aspects of the present invention.

Referring to FIG. 4, "center apex", e.g., the center apex 138, as used herein, refers to a point of intersection between an imaginary vertical plane 140 and the top of the striking face 106, with the club head 101 in the reference position. The imaginary vertical plane 140 is oriented perpendicular to the imaginary hosel plane 104 and passes through the face center 118.

Figure 5:
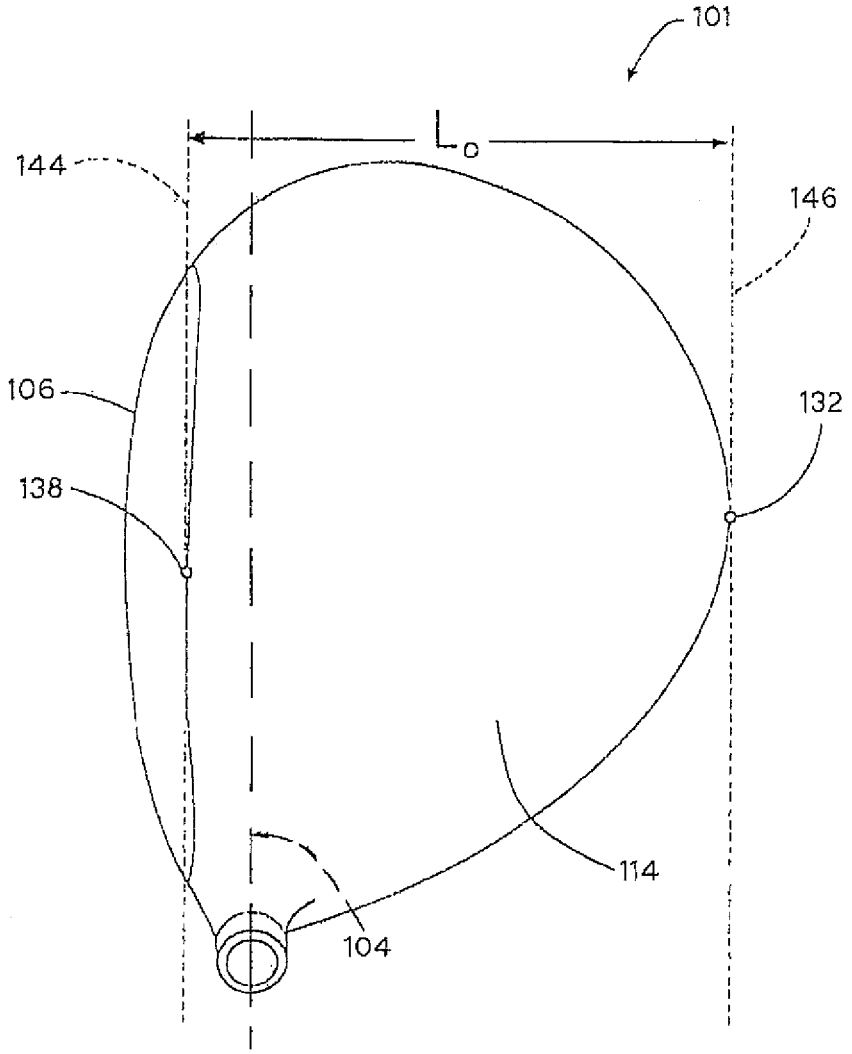
FIG. 5 is a top plan view of an exemplary golf club head according to one or more aspects of the present invention.

Referring to FIG. 5, "overall length", e.g., the overall length $L_o$, as used herein, denotes the shortest horizontal distance between a first imaginary vertical plane 144, parallel to the imaginary hosel plane 104 and passing through the center apex 138, and a second imaginary vertical plane 146, parallel to the first imaginary vertical plane 144 and passing through a rearward-most extent 132 of the club head 101, considered when the golf club head 101 is in the reference position.

Figure 6:
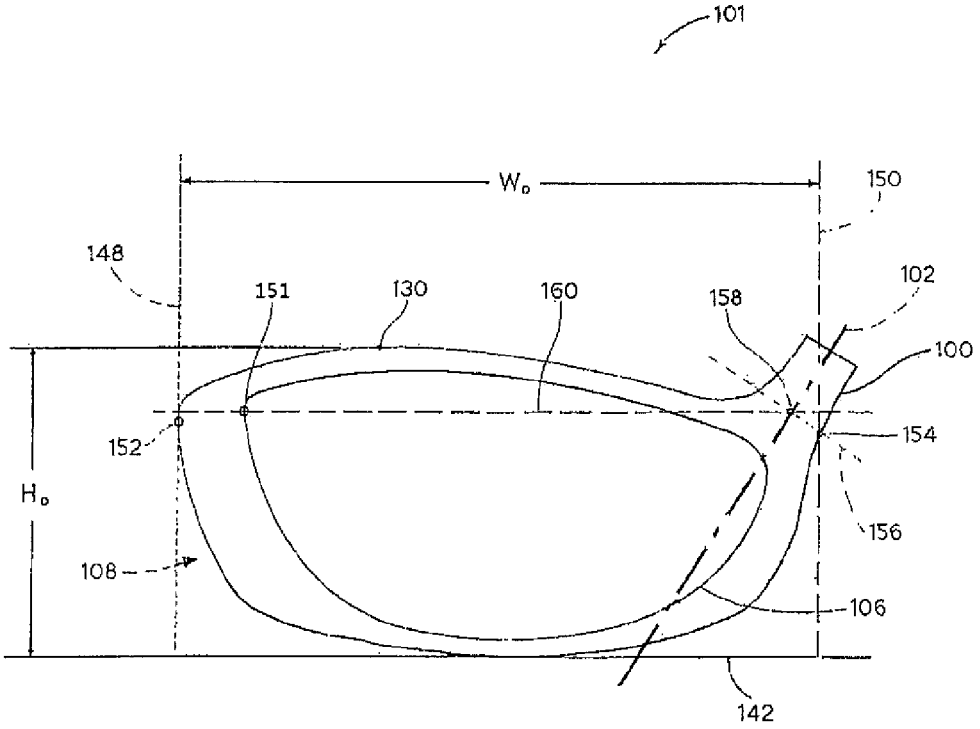
FIG. 6 is a front elevational view of an exemplary golf club head according to one or more aspects of the present invention.

Referring to FIG. 6, "front toe point," e.g., a front toe point 151, as used herein, denotes the furthest laterally projecting point of the striking face 106 proximate the toe portion 108. An imaginary horizontal plane 160, passing through the front toe point 151, will intersect the hosel centerline 102 at a point 158. "Hosel," e.g., the hosel 100, as used herein, denotes a portion of the club head 101 delimited from the rest of the head 101 by an imaginary plane 156, normal to the hosel centerline 102 and containing the point 158.

Referring again to FIG. 6, "overall width," e.g., the overall width $W_o$, as used herein, denotes the shortest horizontal distance between a first imaginary vertical plane 148, perpendicular to the imaginary hosel plane 104 (see, e.g., FIG. 4) and passing through a toeward-most point 152, and a second imaginary vertical plane 150, perpendicular to the hosel plane 104 and passing through a heelward-most point 154 of the imaginary plane 156.

"Overall height," e.g., overall height $H_o$, denotes the vertical distance from the ground plane 142 to the highest point 130 on the golf club head 101 not including the hosel portion 100, with the golf club head 101 in the reference position.

Figure 7:
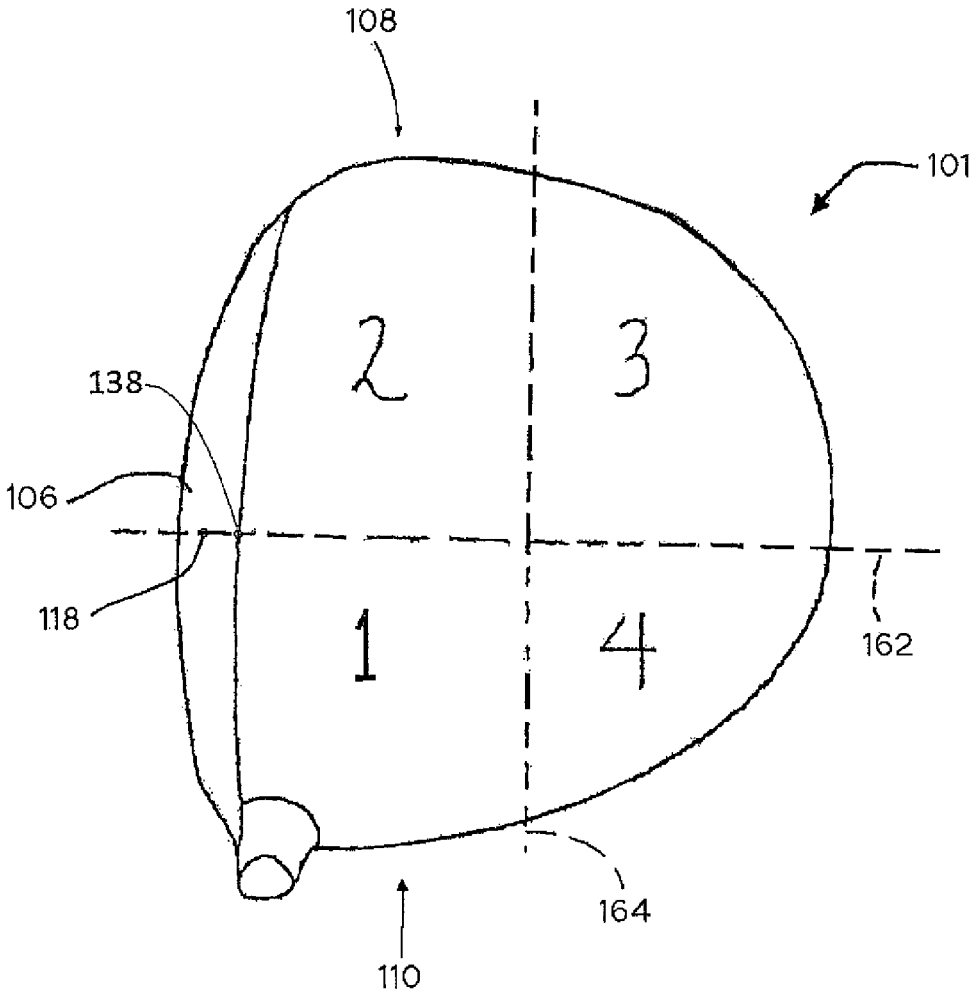
FIG. 7 is a top plan view of an exemplary golf club head according to one or more aspects of the present invention.

As illustrated in FIG. 7, the club head 101, oriented in the reference position, is divided into four quadrants by an imaginary vertical plane 162, substantially orthogonal to the striking face 106 and passing through the face center 118, and an imaginary vertical plane 164, orthogonal to the imaginary vertical plane 162 and spaced from the center apex 138 one-half the overall length, $L_o$. A first quadrant, Quadrant 1, is proximate the striking face 106 and the heel portion 110 of the club head 101. A second quadrant, Quadrant 2, is proximate the striking face 106 and the toe portion 108 of the club head 101. A third quadrant, Quadrant 3, is proximate the toe portion 108 and is located rearward of Quadrant 2. A fourth quadrant, Quadrant 4, is proximate the heel portion 110 and is located rearward of Quadrant 1.

Figure 8:
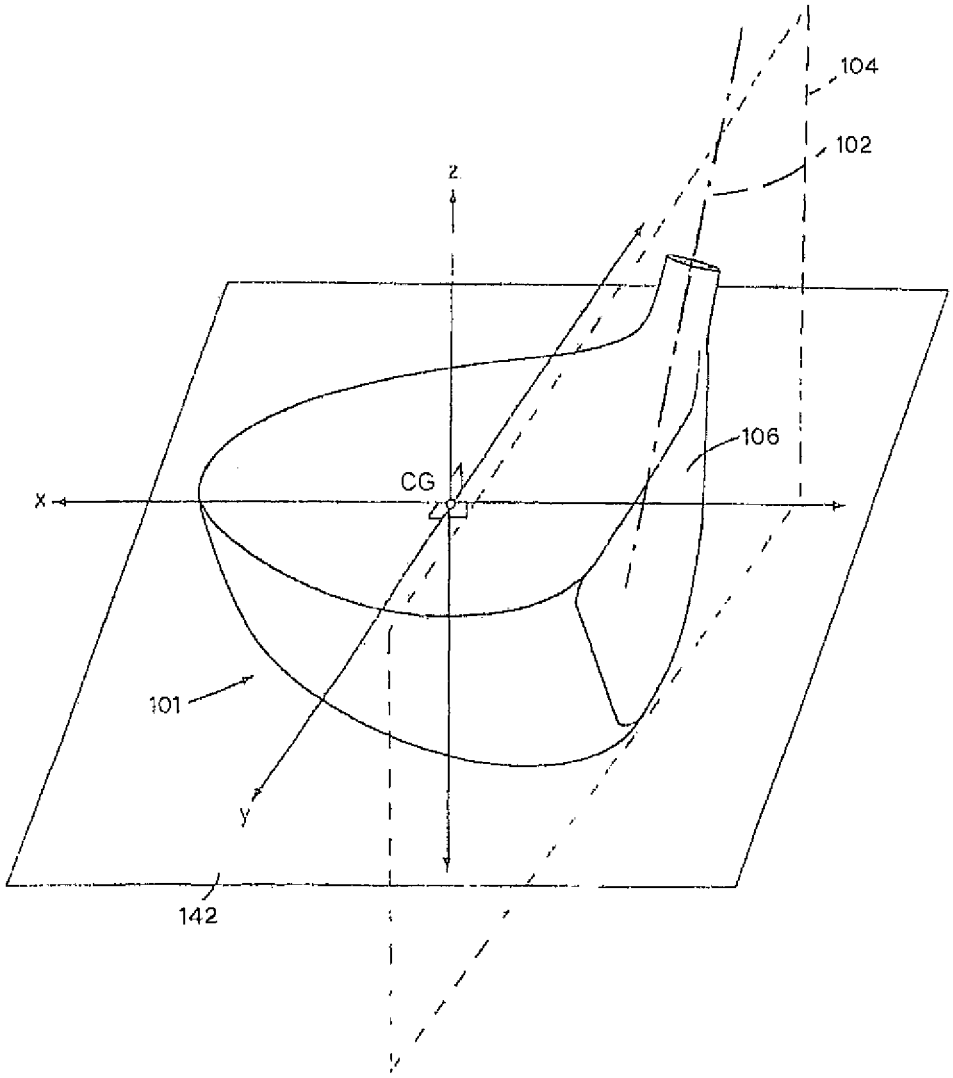
FIG. 8 is a perspective view of an exemplary golf club head according to one or more aspects of the present invention.

FIG. 8 illustrates an imaginary three-dimensional Cartesian coordinate system, having axes x, y, and z, with its origin at the center of gravity CG of the club head 101, oriented in the reference position. The z-axis is vertical and is parallel to the hosel plane 104, containing the hosel centerline 102. The y-axis is substantially parallel to the hosel plane 104 and is perpendicular to the z-axis. The x-axis is perpendicular to the z-axis and the y-axis.

The moment of inertia $I_{zz}$ about the z-axis (the primary MOI) and the moment of inertia $I_{yy}$ about the y-axis (the secondary MOI) of the club head 101 may be found using the general methodology disclosed in the Procedure for Measuring the Moment of Inertia of Golf Clubheads, Revision 1.0 (Apr. 12, 2006), as specified by the United States Golf Association (USGA) and R&A Rules Limited (R&A), with procedural modifications for measuring $I_{yy}$ discussed below. The USGA Procedure for Measuring the Moment of Inertia of Golf Clubheads and the associated "USGA MOI Calculation.xls" program are herein incorporated by reference in their entirety.

Figure 9:
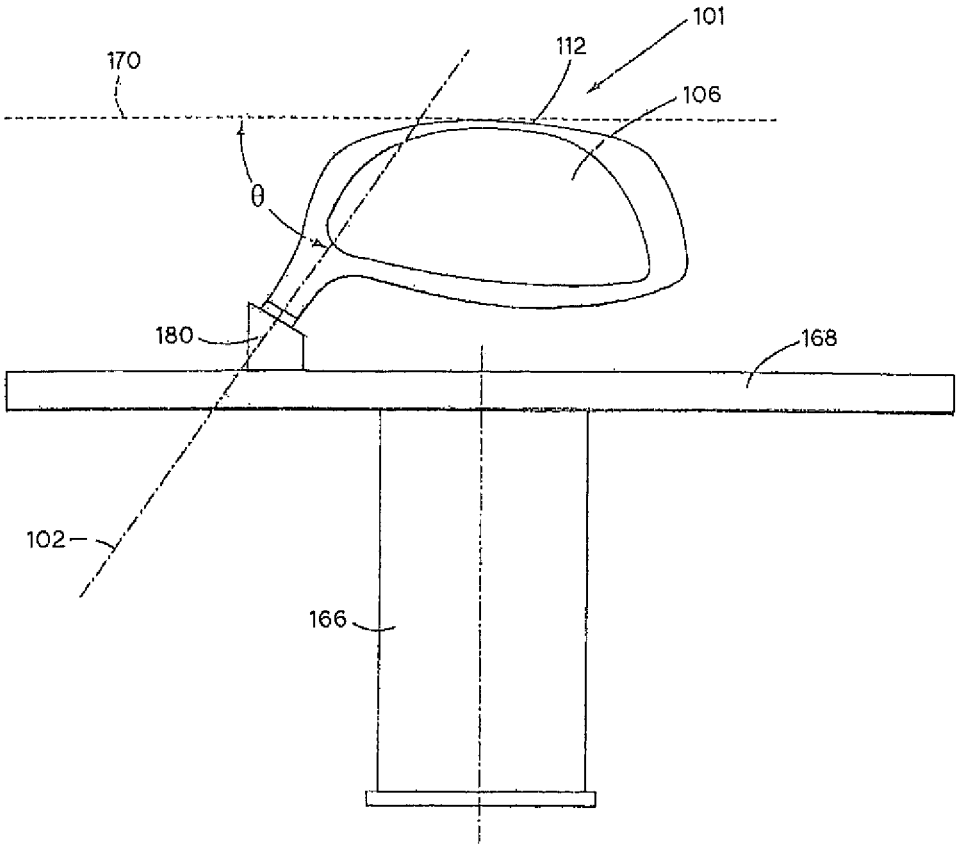
FIG. 9 illustrates an instrument for measuring the primary moment of inertia of the exemplary golf club head of FIG. 8.
Figure 10:
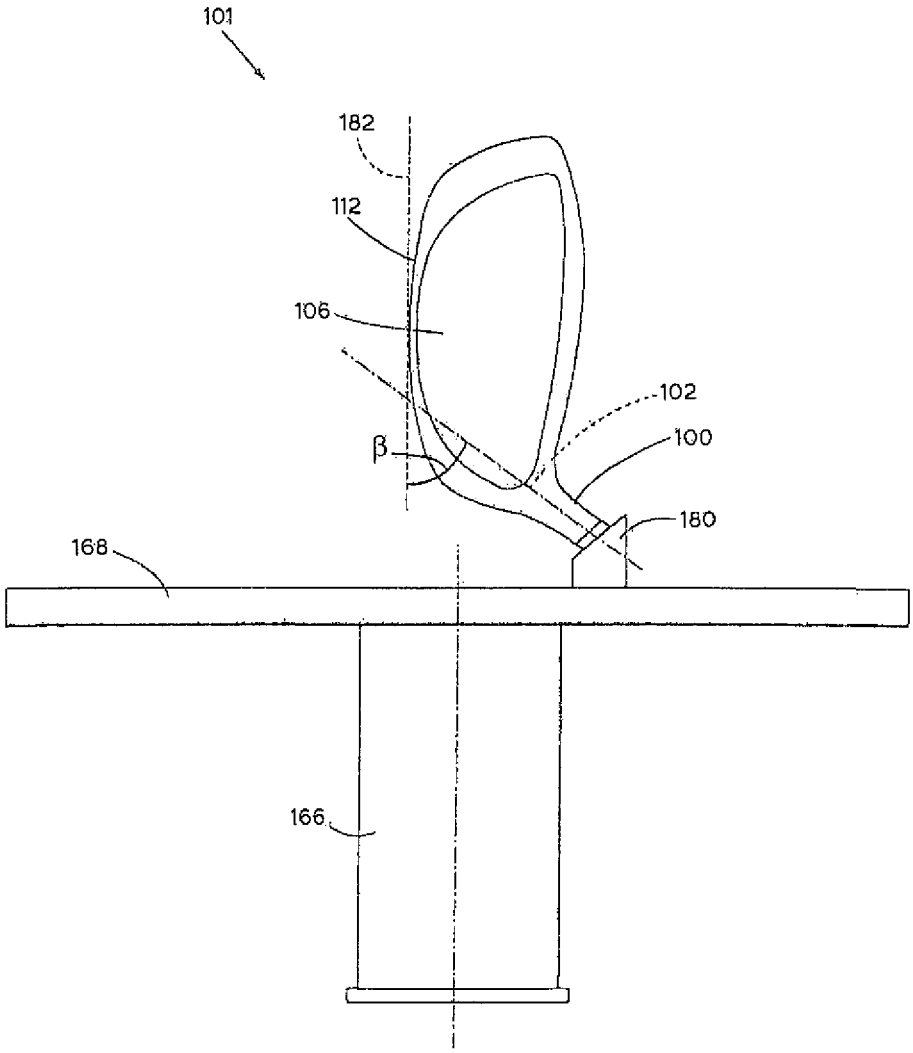
FIG. 10 illustrates an instrument for measuring the secondary moment of inertia of the exemplary golf club head of FIG. 8.

As described in the USGA Procedure for Measuring the Moment of Inertia of Golf Clubheads, a measuring instrument 166 (see FIGS. 9 and 10), e.g., the Moment of Inertia Instrument (Model #MOI-005-104), available from Inertia Dynamics, Inc. of New Hartford, Conn., designed for measuring the moment of inertia of test parts having mass properties and overall dimensions similar to that of a golf club head, may be used to obtain the moment of inertia $I_{zz}$ about the z-axis and the moment of inertia $I_{yy}$ about the y-axis of the golf club head 101. Referring once again to FIGS. 9 and 10, a horizontal jig plate 168, described in the USGA Procedure for Measuring the Moment of Inertia of Golf Clubheads, is attached to the measuring instrument 166, such that the jig plate 168 and the measurement instrument 166 are level.

Figure 11:
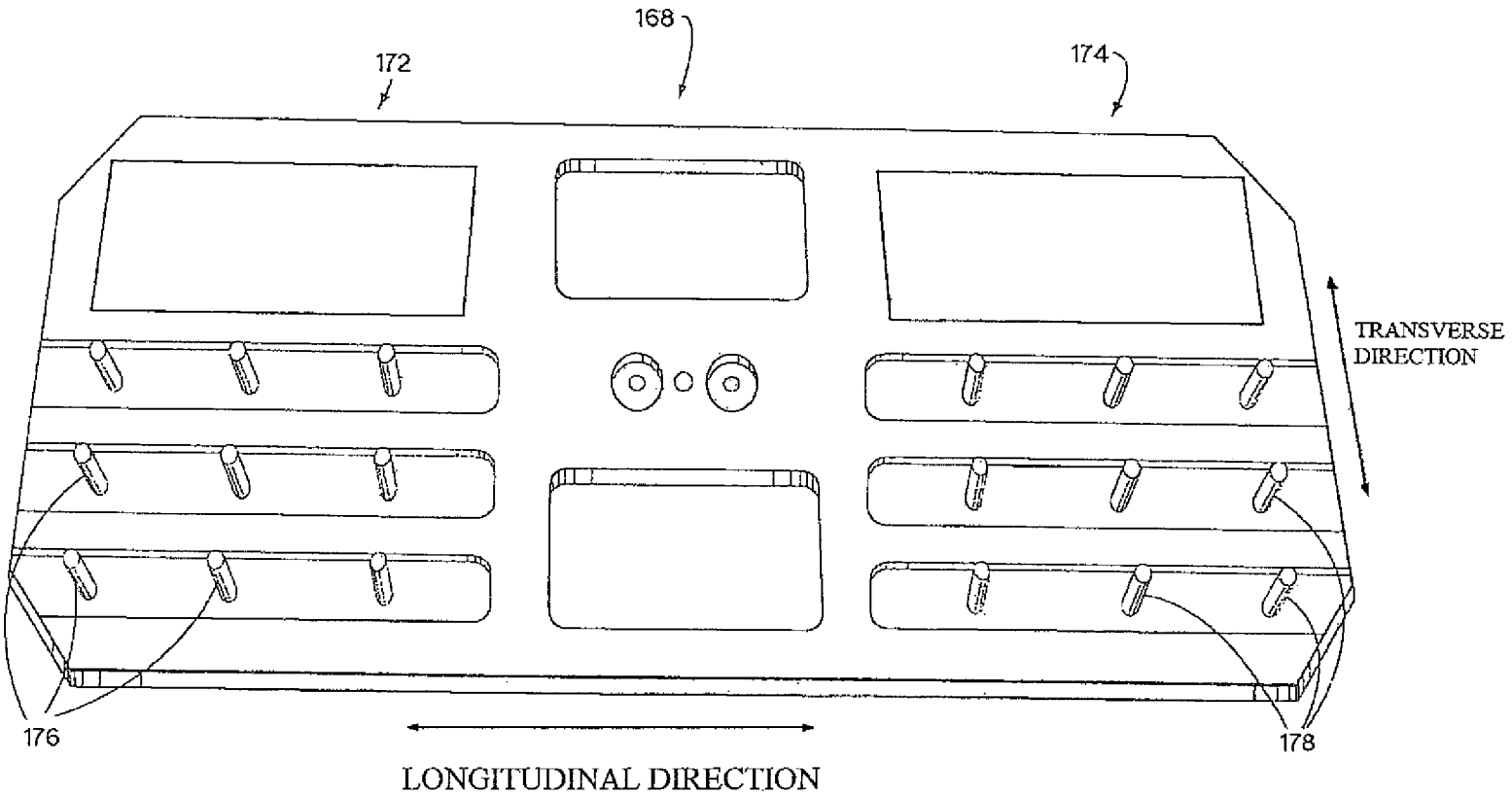
FIG. 11 is a perspective view of a jig plate utilized with the measurement instrument shown in FIGS. 9 and 10.

As shown in FIG. 11, the jig plate 168 has a first side 172 and a second side 174. The first side 172 includes mounting pins 176 and the second side 174 includes mounting pins 178. Pins 176 and 178 comprise rows arranged longitudinally with respect to the jig plate 168 and columns arranged transversely with respect to the jig plate 168.

For purposes of measuring the primary MOI of the club head 101, an adapter 180 (FIG. 9) is used to orient the club head 101 relative to the jig plate 168 such that the bottom portion 112 of the club head 101 is facing up and the club head 101 is located such that the angle θ between the hosel centerline 102 and an imaginary horizontal plane 170 is substantially 60°. Furthermore, the striking face 106 of the club head 101 is substantially parallel to the longitudinal rows of mounting pins 176 and 178. For purposes of measuring the primary MOI of the club head 101, the pins 176 on the first side 172 of the jig plate 168 are used for right-handed club heads and the pins 178 on the second side 174 of the jig plate 168 are used for left-handed club head.

For purposes of measuring the secondary MOI of the club head 101, an adapter 180 (FIG. 10) is utilized to orient the club head 101 with respect to the jig plate 168 so that the bottom portion 112 of the club head 101 is substantially vertical. In other words, the club head 101 is located with respect to the jig plate 168 such that the angle β between the hosel centerline 102 and an imaginary vertical plane 182 is substantially 60°.

Furthermore, as provided in the USGA Procedure for Measuring the Moment of Inertia of Golf Clubheads, the striking face 106 of the club head 101 is substantially parallel to the longitudinal rows of mounting pins 176 and 178. For purposes of measuring the secondary MOI of the club head 101, the mounting pins 176 on the first side 172 of the jig plate 168 are used for left-handed club heads and the pins 178 on the second side 174 of the jig plate 168 are used for right-handed club heads.

Figure 12A:
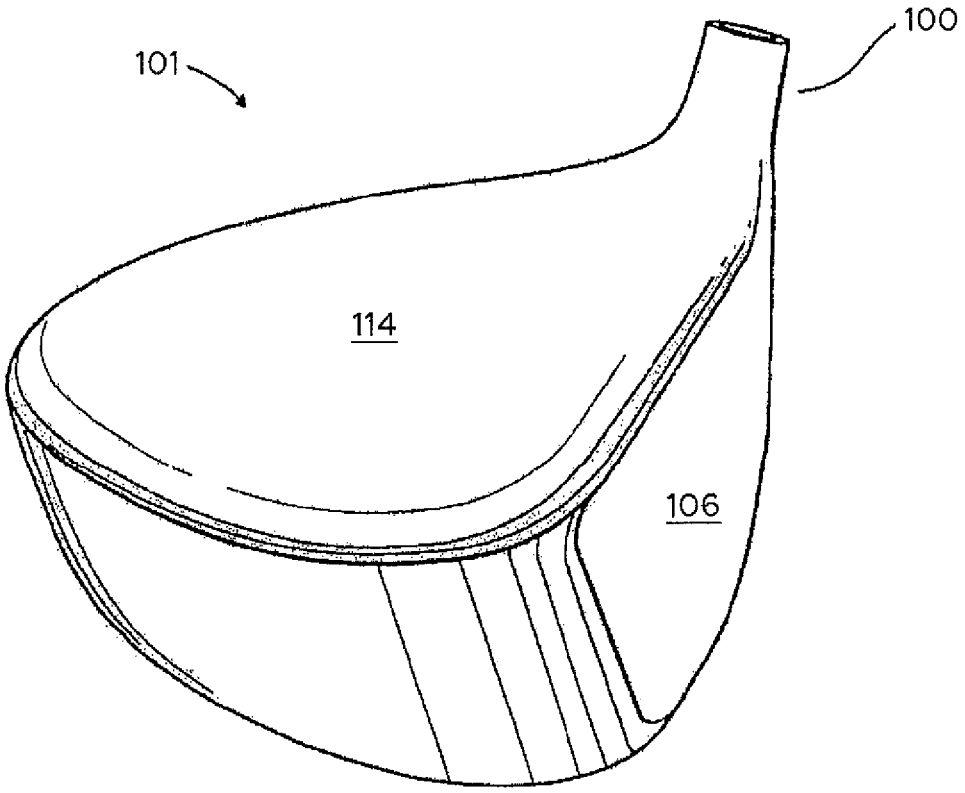
FIG. 12(*a*) is a perspective view of an exemplary golf club head according to one or more aspects of the present invention.
Figure 12B:
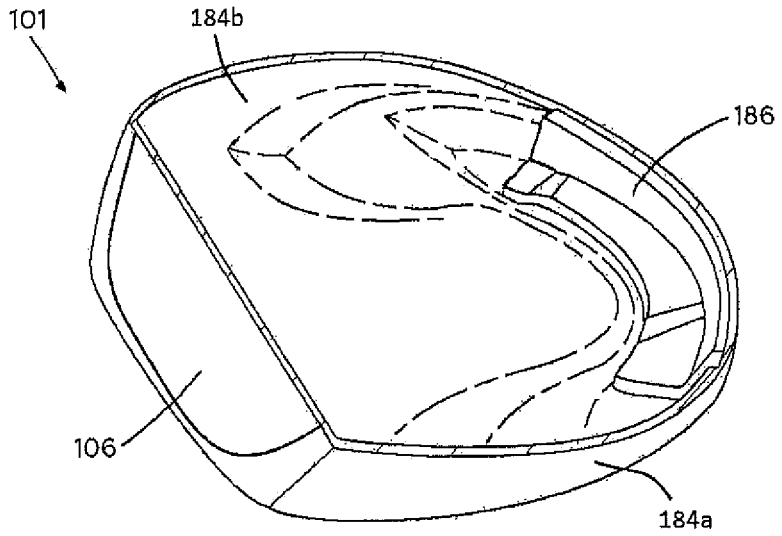
Figure 12C:
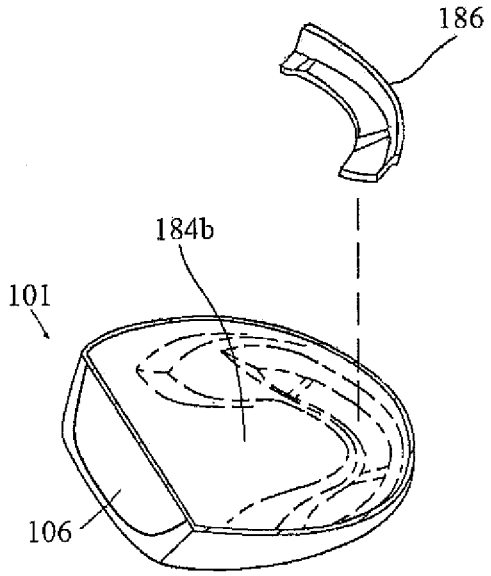
Figure 13A:
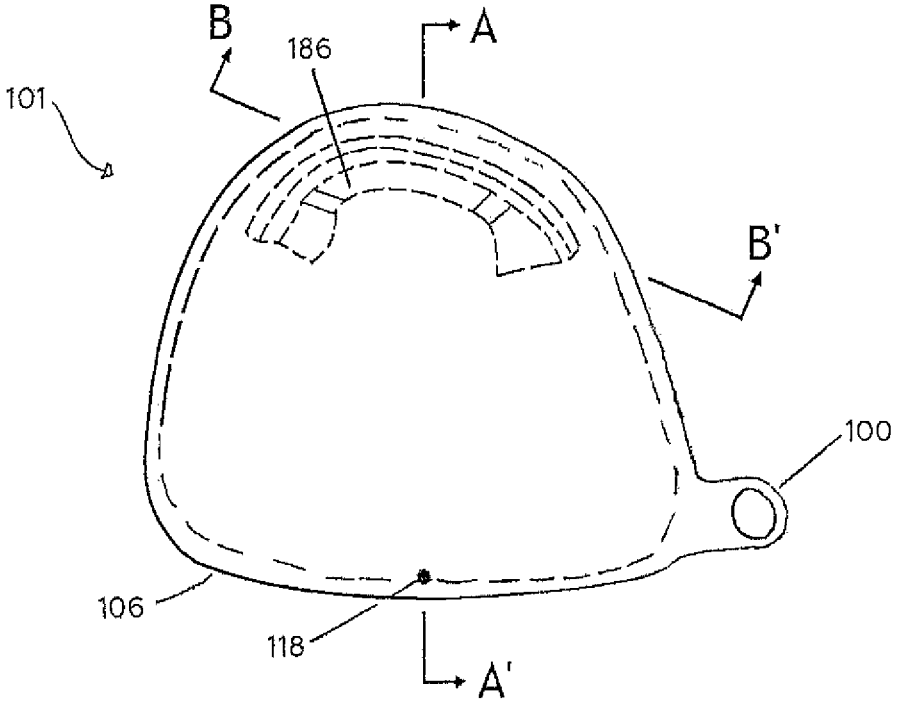
FIG. 13(*a*) is a top plan view of an exemplary golf club head according to one or more aspects of the present invention.
Figure 13B:
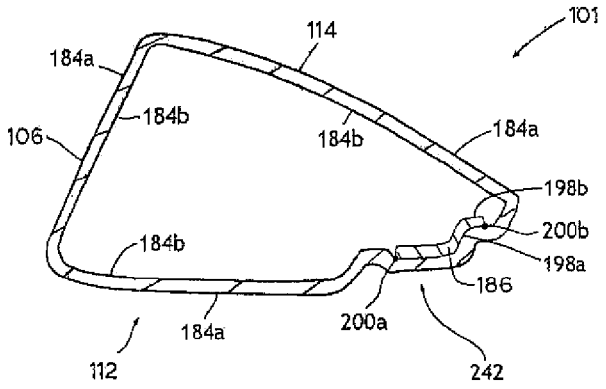
Figure 13C:
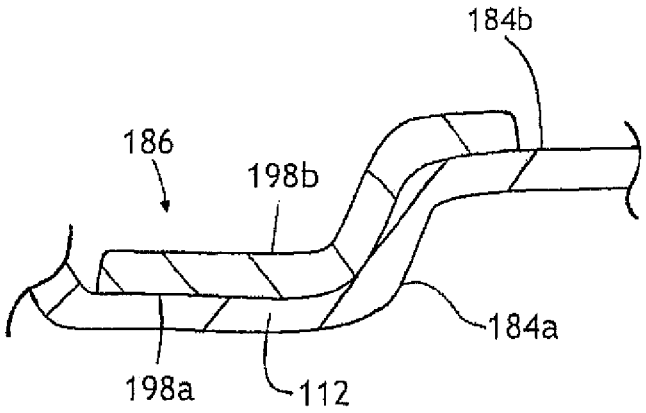
Figure 13D:
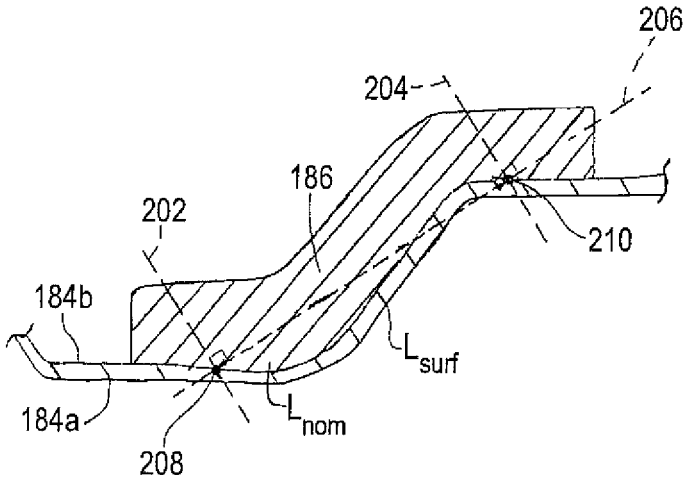
Figure 13E:
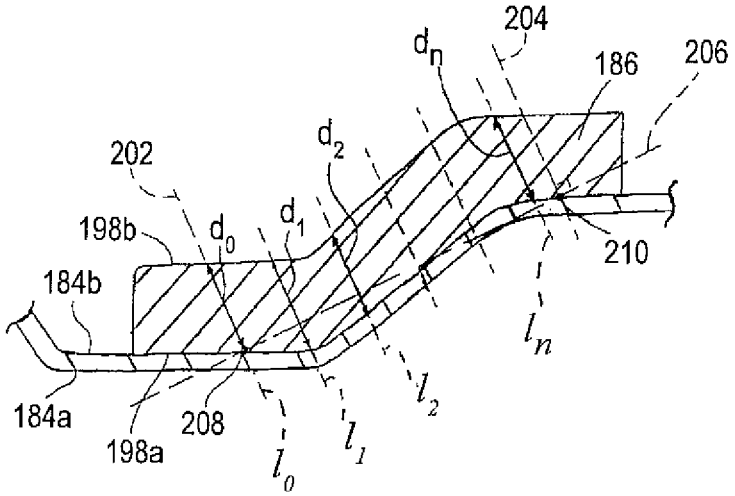
Figure 13F:
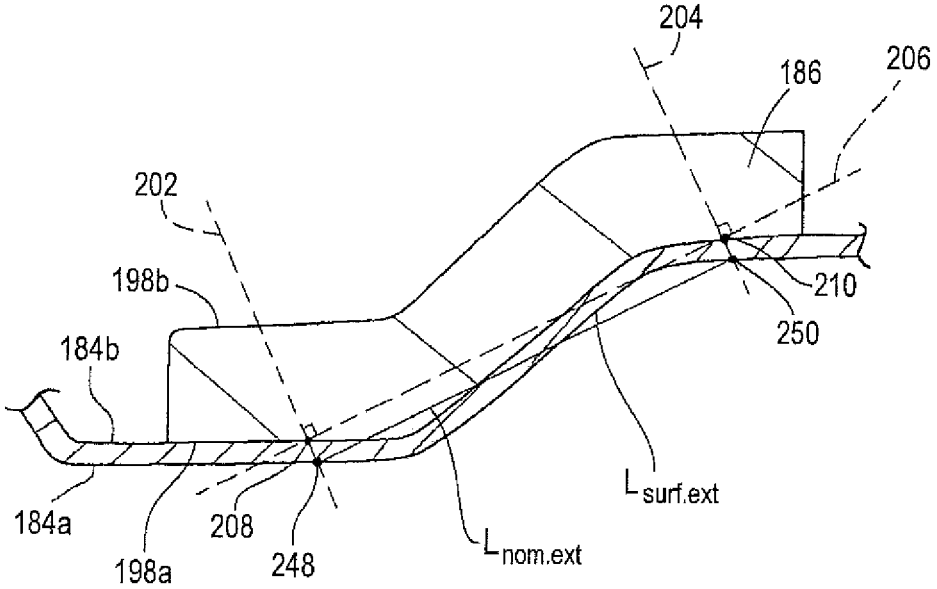
Figure 13G:
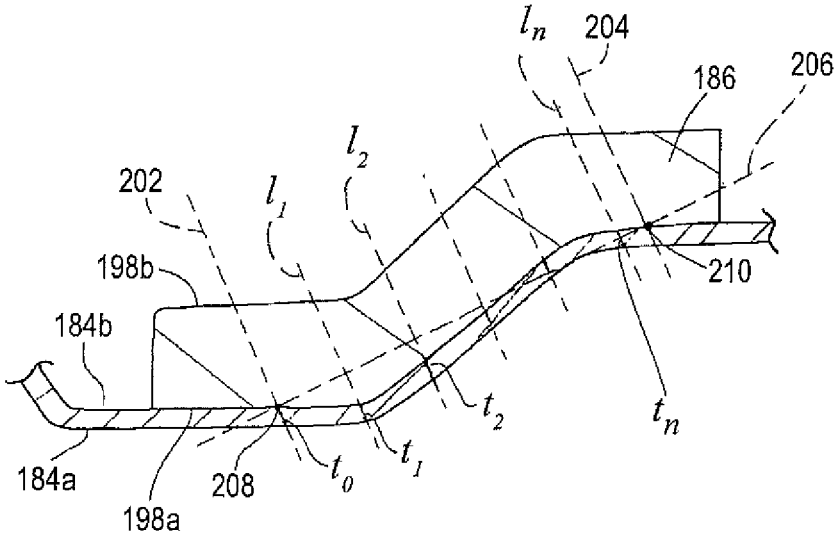
Figure 13H:
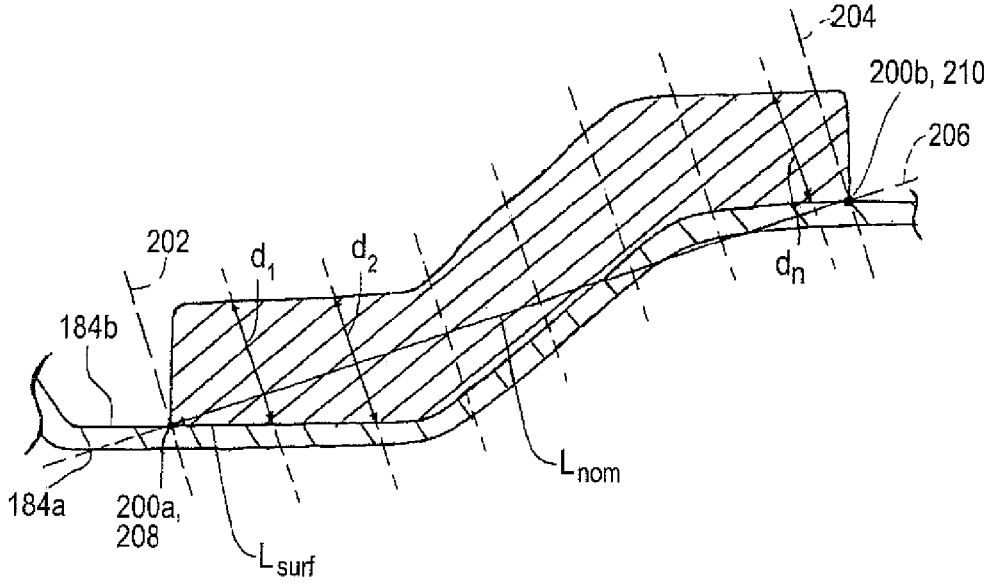
Figure 13I:
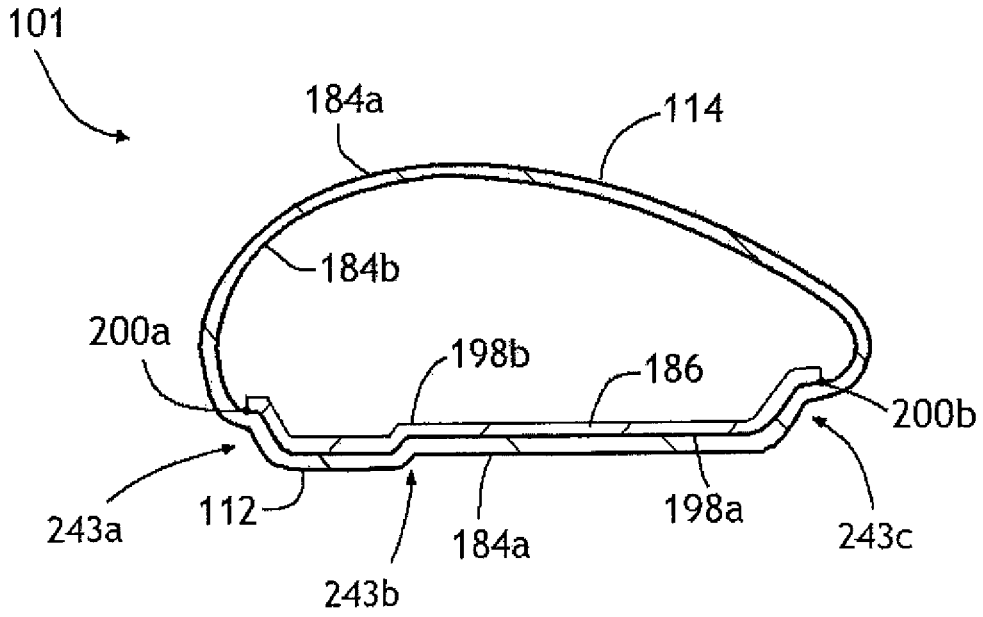
Figure 14A:
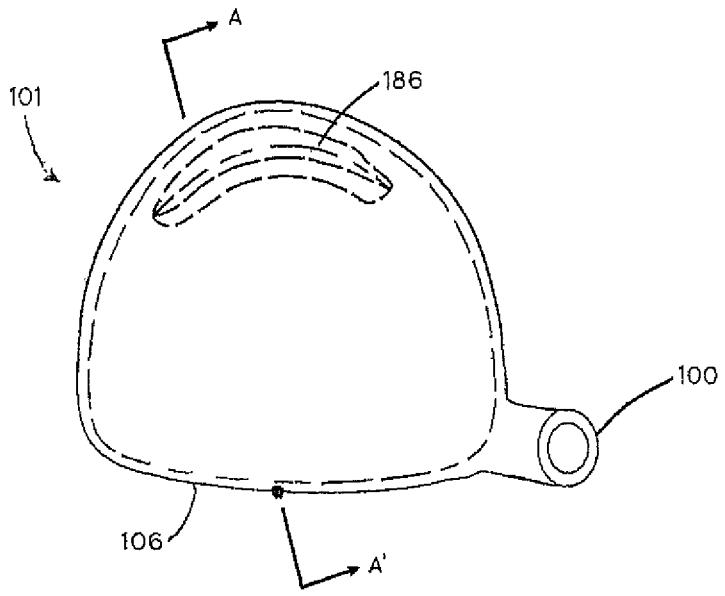
FIG. 14(*a*) is a top plan view of an exemplary golf club head according to one or more aspects of the present invention.
Figure 14B:
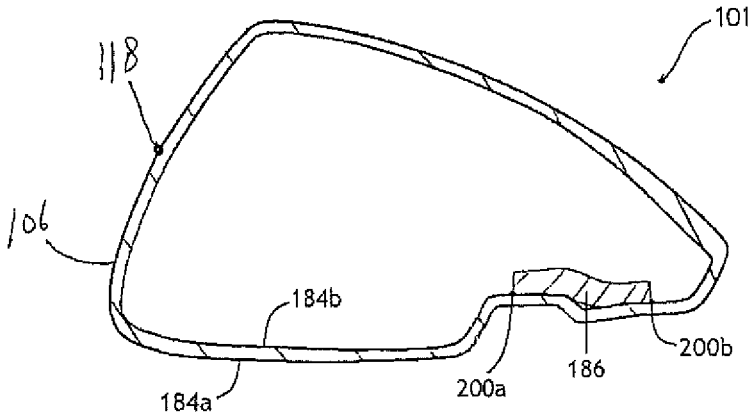
Figure 14C:
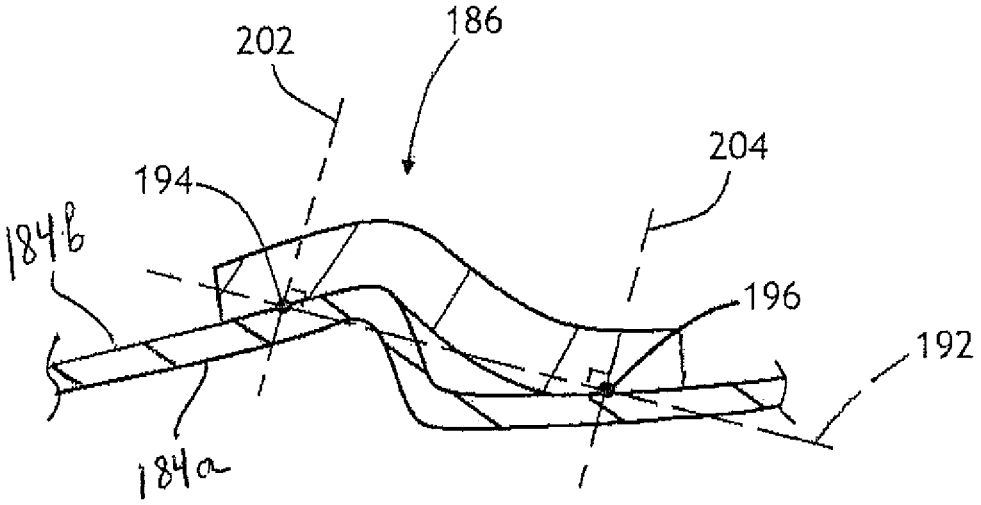
Figure 14D:
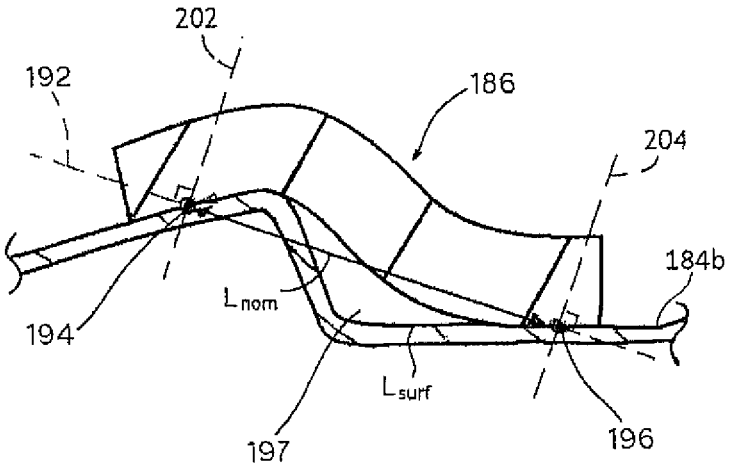
Figure 14E:
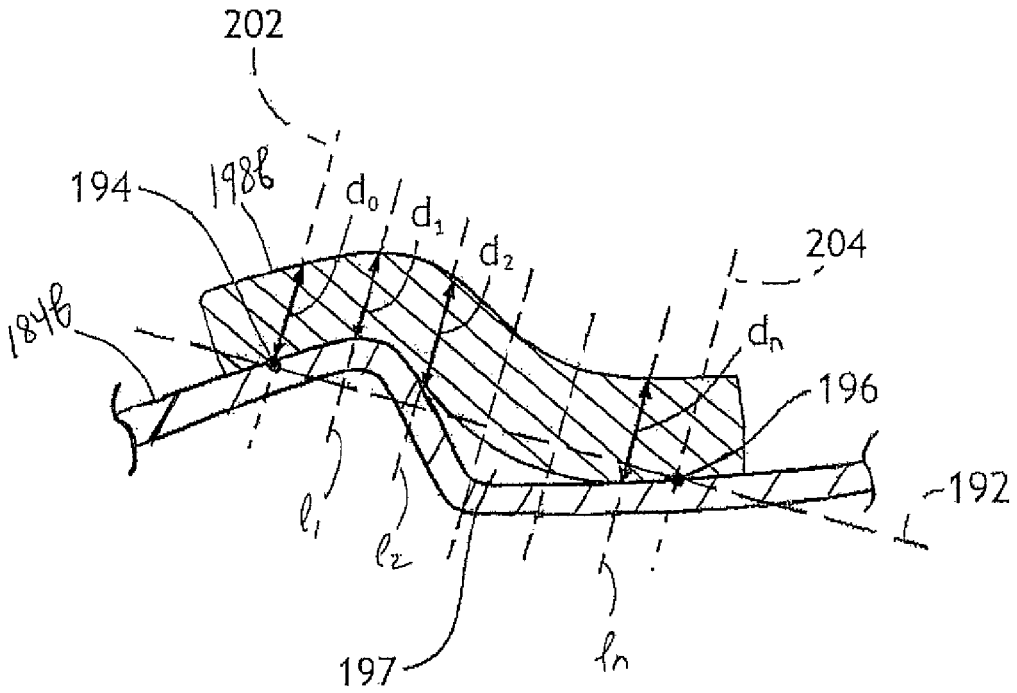
Figure 14F:
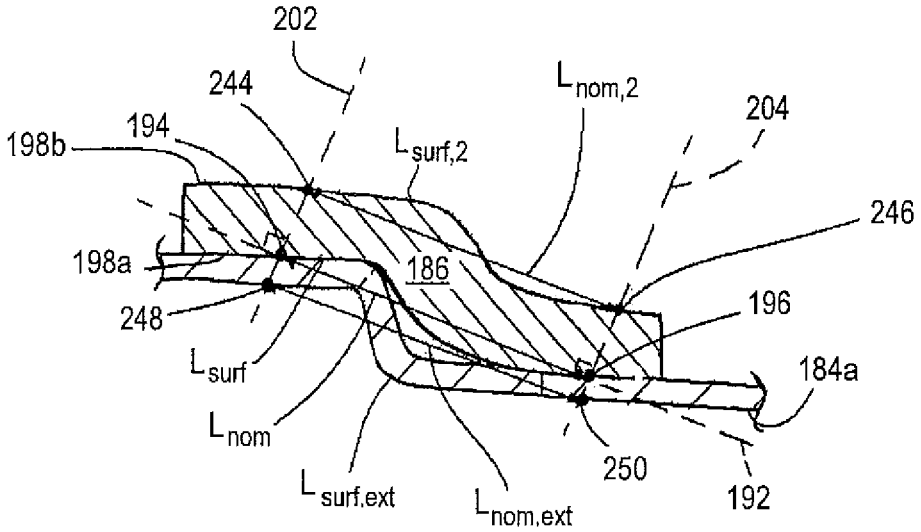
Figure 14G:
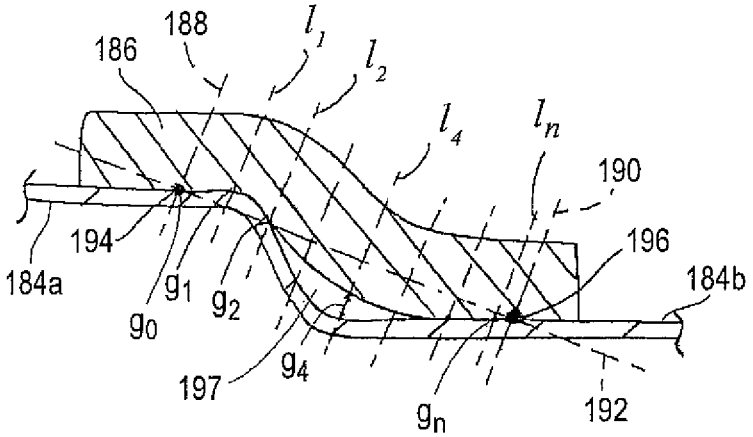

Referring to FIGS. 12(*a*)-12(*c*), in one or more aspects of the present invention, a golf club head 101 comprises a main body including a top portion 114, a bottom portion 112, a striking face 106, and a hosel portion 100. The main body further includes an exterior surface 184*a* and an opposing interior surface 184*b* (see, e.g., FIG. 12(*b*)). A weight member 186 is secured to the interior surface 184*b* of the club head 101. The golf club head 101 preferably comprises a volume greater than or equal to about 250 $cm^3$ and a mass greater than or equal to about 150 g. More preferably, the golf club head 101 comprises a volume greater than or equal to about 350 $cm^3$ and a mass greater than or equal to about 175 g. Most preferably, the golf club head 101 comprises a volume greater than or equal to about 400 $cm^3$ and a mass greater than or equal to about 190 g. The golf club head 101 is preferably a wood-type golf club head. However, in one or more aspects of the present invention, the golf club head 101 may be an iron-type or a putter-type golf club head.

Referring to FIGS. 13(*a*)-13(*b*), the bottom portion 112 of the golf club head 101 includes an irregularly-contoured portion 242 (see FIG. 13(*b*)). Specifically, the bottom portion 112 of the club head 101 includes a portion having abrupt change in curvature. In one or more aspects of the present invention, the bottom portion 112, or any other surface of the club head 101, may comprise inflections, sharp angles, undulations, ridges, grooves, projections, or recesses. Such irregular contour may improve the rigidity of the club head 101, improve aerodynamics, and improve aesthetics. Also, by improving rigidity of a portion of the club head 101, mass may be relocated to a more desirable portion of the club head 101. Irregularly-contoured surfaces may be formed by casting or by forging, which may include bending, stamping, or pressing.

The weight member 186 is configured to generally conform to the irregularly-contoured portion 242 of the interior surface 184*b* of the club head 101. Preferably, the weight member 186 is secured to the bottom portion 112 of the club head 101. As shown in FIG. 13(*b*), the weight member 186 includes a first surface 198*a* that is proximate the interior surface 184*b* and a second surface 198*b* that is distal the interior surface 184*b*. In alternative aspects of the present invention, the weight member 186 may be secured to the striking face 106 and/or the top surface 114 of the club head 101.

By configuring the weight member 186 to conform to the irregularly-contoured portion 242, the center of gravity of the club head 101 may be more advantageously positioned. Specifically, the center of gravity of the club head 101 may be lower in height and more rearward. Further, the moment of inertia of the club head 101 may be increased as discretionary mass is relocated toward the outer extents of the club head 101.

Configuring the weight member 186 to conform to the irregularly-contoured portion of the interior surface 184*b* reduces manufacturing costs and improves precision in assembly. If the first surface 198*a* of the weight member 186 generally conforms to the interior surface 186 of the golf club head 101, then an assembler is able to position the weight member 186 more quickly. Also, configuring the weight member 186 to conform to the irregularly-contoured portion 242 of the interior surface 184*b* reduces the likelihood of mis-locating the weight member 186 during assembly, which would result in a golf club head that is not manufactured according to specification. Further, the weight member 186 may stiffen the irregularly-contoured portion, improving the vibratory characteristics of the club head 101. Preferably, in an assembled state, the club head 101 comprises a primary natural frequency within the range of about 2800 Hz to about 4800 Hz. More preferably, the club head 101 comprises a primary natural frequency within the range of about 3000 Hz to about 4600 Hz. Most preferably, the club head 101 comprises a primary natural frequency within the range of about 3200 Hz to about 4400 Hz.

The weight member 186 preferably has a mass within the range of about 4% of the total mass of the club head 101 to about 12% of the total mass of the club head 101. More preferably, the mass of the weight member 186 is within the range of about 6% of the total mass of the club head 101 to about 10% of the total mass of the club head 101. Specifically, the weight member 186 preferably has a mass greater than or equal to about 8 g. More preferably, the weight member 186 has a mass greater than or equal to about 12 g. Most preferably, the weight member 186 has a mass greater than or equal to about 15 g. The volume of the weight member 186 is preferably greater than or equal to about 2.75 cc. More preferably, the volume of the weight member 186 is greater than or equal to about 3.25 cc. Most preferably, the volume of the weight member 186 is greater than or equal to about 3.75 cc.

Preferably, when the club head 101 is in the reference position, the weight member 186 has a projection area, i.e., a projected area of a region delimited by the periphery of the weight member 186 onto the ground plane 142, of at least about 2 $cm^2$ (see FIG. 13(*a*)). More preferably, the projected area is at least about 3 $cm^2$. Most preferably, the projected area is at least about 5 $cm^2$.

The weight member 186 may comprise titanium or a titanium alloy, stainless steel, aluminum, tungsten, copper, a polymer, or any combination thereof. Preferably, the weight member 186 has a density of at least about 3 $g/cm^3$. More preferably, the density of the weight member 186 is at least about 5 $g/cm^3$. Most preferably, the density of the weight member 186 is at least about 7 $g/cm^3$.

In one or more aspects of the present invention, the weight member 186 is cast. However, in other aspects of the present invention, the weight member 186 may be forged, stamped, or formed by other suitable means known in the art. In some aspects of the present invention, to facilitate forging, bending, or pressing, at least the bottom portion of the club head 101 comprises a material having an elongation greater than or equal to about 10%. More preferably, the bottom portion comprises a material having an elongation within the range of about 10% to about 20%. Most preferably, the bottom portion comprises a material having an elongation within the range of about 10% to about 16%

Referring specifically to FIG. 13(*a*), according to one or more aspects of the present invention, a first imaginary vertical plane A-A' passes through the face center 118 and passes through the weight member 186. A second imaginary vertical plane B-B' is generally transverse to vertical plane A-A' and passes through the weight member 186.

Referring to FIGS. 13(*b*) and 13(*c*), the golf club head 101 is shown in cross-section through the vertical plane A-A'. The weight member 186 includes a first lateral end point 200*a* and a second lateral end point 200*b* specific to this cross-section. The weight member 186 further includes a first surface 198*a* that is proximate the interior surface 184*b* of the golf club head 101, and a second surface 198*b* that is distal the interior surface 184*b* of the golf club head 101. As shown in this cross-section, the weight member 186 is contoured to generally conform to the irregularly-contoured portion 242 of the interior surface 184*b* of the golf club head 101. Specifically, both the first surface 198*a* and the second surface 198*b* of the weight member 186 is contoured to generally conform to the interior surface 184*b* of the club head 101. The exterior surface 184*a* of the club head 101 is also contoured to generally conform to the irregularly-contoured portion 242 of the interior surface 184*b* of the club head 101. In alternative aspects of the present invention, the contour of the exterior surface 184*a* does not generally conform to the contour of the interior surface 184*b*.

Referring to FIG. 13(*d*), a portion of the cross-section shown in FIG. 13(*b*) is shown in more detail. A first point 208 and a second point 210 are located on the interior surface 184*b*. An imaginary line 206 passes through the first point 208 and the second point 210. A first imaginary boundary line 202 passes through the first point 208 perpendicular to the imaginary line 206, A second imaginary boundary line 204 passes through the second point 210 perpendicular to the imaginary line 206. The first imaginary boundary line and the second imaginary boundary line each pass through the weight member 186.

Referring once again to FIG. 13(*d*), in one or more aspects of the present invention, the interior surface 184*b* includes a nominal length $L_{nom}$, between the first point 208 and the second point 210. The nominal length $L_{nom}$ of the interior surface corresponds to the shortest distance between the first point 208 and the second point 210. The interior surface 184*b* also includes a surface length $L_{surf}$, between the first point and the second point. The surface length $L_{surf}$ of the interior surface corresponds to the actual length of the interior surface 184*b* between the first point 208 and the second point 210.

Referring to FIG. 13(*e*), between the first point 208 and the second point 210, the weight member 186 is spaced from the interior surface 184*b* by an average distance $d_{avg}$. The term "average distance," $d_{avg}$, as used herein, denotes an average of a plurality of distances $d_0 \ldots d_n$, each measured perpendicular to the imaginary line 206, which incorporates the points 208 and 210, in a vertical plane containing the imaginary line 206, between the second surface 198*b* of the weight member 186 and the interior surface 184*b* of the main body of the club head 101, where the distance $d_0$ is measured along the imaginary line 202, which passes through the point 208, and the distances $d_1 \ldots d_n$ are measured along a plurality of lines $l_1 \ldots l_n$, oriented parallel to the line 188 and spaced from each other in increments of 1 mm. The line $l_1$ is spaced a distance of 1 mm from the line 202 and the lines $l_1 \ldots l_n$ include no other lines but all lines parallel to the line 202 between the points 208 and 210, such that no line $l_1 \ldots l_n$ passes through the point 208, but the line $l_n$ may pass through the point 210.

From the determined plurality of distances $d_0 \ldots d_n$, and the average distance $d_{avg}$, a standard deviation of the measured distances, $\sigma_d$, is defined as follows:

$$\sigma_d = \sqrt{\frac{(d_0 - d_{avg})^2 + (d_1 - d_{avg})^2 + (d_2 - d_{avg})^2 + \ldots + (d_n - d_{avg})^2}{n}}$$

Based on the above-determined parameters, various factors may be calculated that each correspond to characteristics of the club head 101 between the point 208 and the point 210 in the cross-section A-A'.

First, a conformity factor, $F_{conf}$, of the weight member 186 may be determined based on the average distance, $d_{avg}$, and the standard deviation, $\sigma_d$, of the plurality of distances $d_0 \ldots d_n$. The conformity factor $F_{conf}$ corresponds to the extent to which the contour of the weight member 186 conforms to the contour of the interior surface 184*b* to which it is coupled, between the point 208 and the point 210. The conformity factor $F_{conf}$ is defined as follows:

$$F_{conf}=\sigma_d/d_{avg}$$

Second, an irregularity factor $F_{irr}$ of the interior surface 184*b* may be determined based on the measured nominal length $L_{nom}$ of the interior surface 184*b* and the measured surface length $L_{surf}$ of the interior surface 184*b*, between the first point 208 and the second point 210. The irregularity factor $F_{irr}$ of the interior surface 184*b* corresponds to the extent to which the interior surface 184*b* abruptly changes in curvature between the first point 208 and the second point 210. The irregularity factor $F_{irr}$ is defined as follows:

$$F_{irr}(L_{surf,int}/L_{nom,int})^2$$

Third, a distribution factor $F_{dist}$ of the weight member 186 may be determined based on the average distance $d_{avg}$ of the weight member 186 and the surface length $L_{surf}$ of the interior surface 184*b*, between the first point 208 and the second point 210. The distribution factor $F_{dist}$ of the weight member 186 corresponds to the extent to which the area of the weight member 186 is positioned relatively close to the interior surface 184*b* between the first point 208 and the second point 210 in the imaginary vertical cross-section A-A'. The distribution factor $F_{dist}$ is defined as follows:

$$F_{dist}=d_{avg}/L_{surf,int}$$

Preferably, between the first point 208 and the second point 210, an irregularity factor of the interior surface 184*b* is greater than or equal to 1.2, a conformity factor of the weight member 186 is less than or equal to 0.07, and a distribution factor of the weight member 186 is less than or equal to 1.0. More preferably, between the first point 208 and the second point 210, an irregularity factor of the interior surface 184*b* is greater than or equal to 1.2, a conformity factor of the weight member 186 is less than or equal to 0.05, and a distribution factor of the weight member 186 is between 0.1 and 1.0. Most preferably, between the first point 208 and the second point 210, the irregularity factor of the interior surface 184*b* is greater than or equal to 1.2, the conformity factor of the weight member 186 is less than or equal to about 0.04, and the distribution factor of the weight member 186 is between 0.25 and 1.0.

Referring to FIG. 13(*f*), in one or more aspects of the present invention, between the first point 208 and the second point 210, the second surface 198*b* of the weight member 186, the interior surface 184*b* of the club head 101, and the exterior surface 184*a* of the club head 101 all conform to each other. In addition to the parameters discussed above, a nominal length $L_{nom}$ of the exterior surface 184*a* and the actual length of the exterior surface 184*a*, $L_{surf,ext}$, may be determined between the first point 208 and the second point 210.

Referring to FIG. 13(*g*), in one or more aspects of the present invention, between the first point 208 and the second point 210, the main body has an average thickness, $t_{avg}$. The term "average thickness", $t_{avg}$, as used herein, denotes an average of a plurality of thickness $t_0 \ldots t_n$, each measured perpendicular to the imaginary line 206, which incorporates the points 208 and 210, in a vertical plane containing the imaginary line 206, between the interior surface 184*b* of the main body and the exterior surface 184*a* of the main body of the club head 101, where the thickness $t_0$ is measured along the imaginary line 202, which passes through the point 208, and the thicknesses $t_1 \ldots t_n$ are measured along a plurality of lines $l_1 \ldots l_n$, oriented parallel to the line 202 and spaced from each other in increments of 1 mm. The line $l_1$ is spaced a distance of 1 mm from the line 202 and the lines $l_1 \ldots l_n$ include no other lines but all lines parallel to the line 202 between the points 208 and 210, such that no line $l_1 \ldots l_n$ passes through the point 208, but the line $l_n$ may pass through the point 210.

From the plurality of thicknesses $t_0 \ldots t_n$ and the calculated average thickness $t_{avg}$, a standard deviation of the measured thickness, $\sigma_t$, is defined as follows:

$$\sigma_t = \sqrt{\frac{(t_0 - t_{avg})^2 + (t_1 - t_{avg})^2 + (t_2 - t_{avg})^2 + \ldots + (t_n - t_{avg})^2}{n}}$$

A conformity factor of the exterior surface 184*a*, $F_{conf,ext}$, between the first point 208 and the second point 210, may be determined based on the average thickness, $t_{avg}$, and the standard deviation, $\sigma_t$, of the set of measured thicknesses. The conformity factor $F_{conf,ext}$ corresponds to the extent to which the contour of the exterior surface 184*a* conforms to the contour of the interior surface 184*b* between the first point 208 and the second point 210. $F_{conf,ext}$ is defined as follows:

$$F_{conf,ext}=\sigma_t/t_{avg}$$

Preferably, between the first point 208 and the second point 210, $F_{conf,ext}$ is less than or equal to 0.07. More preferably, between the first point 208 and the second point 210, $F_{conf,ext}$ is less than or equal to 0.05. Most preferably, between the first point 208 and the second point 210, $F_{conf,ext}$ is less than or equal to 0.04.

Referring to FIG. 13(*h*), in one or more aspects of the present invention, the weight member 186 substantially conforms to the irregularly-contoured portion 242 over the entire length of the weight member 186 from the first lateral endpoint 200*a* to the second lateral endpoint 200*b*. This can be quantified by having the first point 208 and the second point 210 coincide with the first lateral endpoint 200*a* and the second lateral endpoint 200*b*, respectively. In this specific case, an imaginary line 206 passes through the first lateral endpoint 200*a* and the second lateral endpoint 200*b*. The first imaginary boundary line 202 passes through the first lateral endpoint 200*a* perpendicular to the imaginary line 206. The second imaginary boundary line 204 passes through the second lateral endpoint 200*b* perpendicular to the imaginary line 206.

A nominal length $L_{nom}$ and a surface length $L_{surf}$ may be determined between the first lateral endpoint 200*a* and the second lateral endpoint 200*b*. An average distance $d_{avg}$ that the second surface 198*b* of the weight member 186 is spaced from the interior surface 184*b* between the point 200*a* and the point 200*b*, and a corresponding standard deviation $\sigma_d$, may be determined in the manner described above with regard to the selected points shown in FIG. 13(*g*).

Based on the parameters discussed above, preferably, $F_{irr}$ of the interior surface 184*b* is greater than or equal to 1.2, $F_{conf}$ of the weight member 186 is less than or equal to 0.07, and $F_{dist}$ of the weight member 186 is less than or equal to 1.0. More preferably, $F_{irr}$ of the interior surface 184*b* is greater than or equal to 1.2, and $F_{conf}$ of the weight member 186 is less than or equal to 0.05. Most preferably, $F_{in}$ of the interior surface 184*b* is greater than or equal to 1.2, and $F_{conf}$ of the weight member 186 is less than or equal to about 0.04.

Referring to FIG. 13(*i*), in one or more aspects of the present invention, the golf club head 101 is shown in the cross-section B-B' (see FIG. 13(*a*)). In this cross-section, weight member 186 is coupled to the interior surface 184*b*. The weight member 186 comprises a first lateral endpoint 200*a* and a second lateral endpoint 200*b* that are each specific to the cross-section B-B'. The interior surface 184*b* comprises three distinct irregularly-contoured portions 243*a*, 243*b*, and 243*c*. Proximate the irregularly-contoured portions 243*a*, 243*b*, and 243*c*, the weight member 186 generally conforms to the contour of the interior surface 184*b*. Additionally, in some aspects of the present invention, as shown, the exterior surface 184*a* generally conforms to the contour of the interior surface 184*b*. Alternatively, in some aspects of the present invention, the contour of the exterior surface 184*a* differs from the contour of the interior surface 184*b*.

Referring to FIGS. 14(*a*)-14(*g*), in one or more aspects of the present invention, a golf club head 101, oriented in a reference position, comprises a striking face 106 having a face center 118 and a weight member 186. The golf club head 101 comprises an exterior surface 184*a* and an interior surface 184*b* (see FIG. 14(*b*)). The weight member 186 is secured to the interior surface 184*b* of the club head 101. As shown in FIG. 14(*a*), an imaginary vertical plane A-A' passes through the face center 118 and a portion of the weight member 186.

Referring to FIG. 14(*b*), the golf club head 101 is shown in cross-section through the plane A-A'. The weight member 186 includes a first lateral endpoint 200*a* and a second lateral endpoint 200*b*.

Referring to FIG. 14(*c*), a portion of the imaginary vertical plane A-A' is considered in more detail. A first point 194 and a second point 196 are located on the interior surface 184*b* of the main body of the club head 101. An imaginary line 192 passes through the first point 194 and the second point 196, A first imaginary boundary line 202, lying in the imaginary vertical plane A-A', passes through the first point 194 perpendicular to the imaginary line 192. A second imaginary boundary line 204, lying in the imaginary vertical plane A-A', passes through the second point 196 perpendicular to the imaginary line 192. The first imaginary boundary line 202 and the second imaginary boundary line 204 each pass through the weight member 186.

Referring to FIG. 14(*d*), in one or more aspects of the present invention, the interior surface 184*b* includes a nominal length $L_{nom}$ between the first point 194 and the second point 196. The nominal length $L_{nom}$, of the interior surface 184*b* corresponds to the shortest distance between the first point 194 and the second point 196. The interior surface 184*b* also includes a surface length $L_{surf}$ between the first point 194 and the second point 196. The surface length $L_{surf}$ of the interior surface 184*b* corresponds to the actual length of the interior surface 184*b* between the first point 194 and the second point 196. A gap 197 is located between the first surface 198*a* of the weight member 186 and the interior surface 184*b* of the main body.

Referring to FIG. 14(*e*), the weight member 186 is spaced from the interior surface 184*b* by an average distance, $d_{avg}$, between the first point 194 and the second point 186. The term "average distance," $d_{avg}$, as used herein, denotes an average of a plurality of distances $d_0 \ldots d_n$, each measured perpendicular to the imaginary line 192, which incorporates the points 194 and 196, in a vertical plane containing the imaginary line 192, between the second surface 198*b* of the weight member 186 and the interior surface 184*b* of the main body of the club head 101, where the distance $d_0$ is measured along the imaginary line 202, which passes through the point 194, and the distances $d_1 \ldots d_n$ are measured along a plurality of lines $l_1 \ldots l_n$, oriented parallel to the line 202 and spaced from each other in increments of 1 mm. The line $l_1$ is spaced a distance of 1 mm from the line 202 and the lines $l_1 \ldots l_n$ include no other lines but all lines parallel to the line 202 between the points 194 and 196, such that no line $l_1 \ldots l_n$, passes through the point 194, but the line $l_n$ may pass through the point 196.

From the determined plurality of distances $d_0 \ldots d_n$, a standard deviation of the plurality of distances, $\sigma_d$, is defined as follows:

$$\sigma_d = \sqrt{\frac{(d_0 - d_{avg})^2 + (d_1 - d_{avg})^2 + (d_2 - d_{avg})^2 + \ldots + (d_n - d_{avg})^2}{n}}$$

Based on the above-measured parameters, an irregularity factor $F_{irr}$ of the interior surface 184*a*, a conformity factor $F_{conf}$ of the weight member 186, and a distribution factor $F_{dist}$ of the weight member 186 may be determined, between the first point 194 and the second point 196, in the manner described above with regard to the aspect of the present invention shown in FIG. 13(*a*).

The interior surface 184*b* and the weight member 186 of the club head 101 are preferably configured such that, between the first point 194 and the second point 196, $F_{irr}$ of the interior surface 184*b* is greater than or equal to 1.2, $F_{irr}$ of the weight member 186 is less than or equal to 0.07, and $F_{dist}$ of the weight member 186 is less than or equal to 1.0. More preferably, between the first point 194 and the second point 196, $F_{irr}$ of the interior surface 184*b* is greater than or equal to 1.2, $F_{conf}$ of the weight member 186 is less than or equal to 0.05, and $F_{dist}$ of the weight member 186 is between 0.1 and 1.0. Most preferably, between the first point 194 and the second point 196, $F_{irr}$ of the interior surface 184*b* is greater than or equal to 1.2, $F_{conf}$ of the weight member 186 is less than or equal to 0.04, and $F_{dist}$ of the weight member 186 is between 0.25 and 1.0.

Referring to FIG. 14(*f*), the portion of the vertical cross-section of FIG. 14(*c*) is shown in further detail. The boundary line 202 passes through the second surface 198*b* of the weight member 186 at a point 244. The boundary line 204 passes through the second surface 198*b* of the weight member 186 at a point 246. The shortest distance between the point 244 and the point 246 corresponds to the nominal length of the second surface 198*b*, $L_{nom,2}$. The actual length of the of second surface 198*b* between the point 244 and the point 246 corresponds to the surface length of the second surface, $L_{surf,2}$.

In addition to the parameters discussed above, an irregularity factor of the second surface 198*b* of the weight member 186, $F_{irr,2}$, corresponds to the extent to which the second surface 198*b* of the weight member 186 abruptly changes in contour, between the first point 194 and the second point 196. The irregularity factor of the second surface 198*b*, $F_{irr,2}$ between the first point 194 and the second point 196, is defined as follows:

$$F_{irr,2}(L_{surf,2}/L_{nom,2})^2$$

The club head 101 is preferably configured such that, between the first point 194 and the second point 196, the second surface 198*b* of the weight member 186 comprises an irregularly factor, $F_{irr,2}$, that is greater than or equal to 1.20 and the interior surface 184*b* of the main body of the club head 101 comprises an irregularity factor, $F_{irr,int}$, that is greater than or equal to 1.20. More preferably, the second surface 198*b* of the weight member 186 comprises an irregularity factor, $F_{irr,2}$, that is greater than or equal to 1.25 and the interior surface 184*b* of the main body of the club head 101 comprises an irregularity factor, $F_{irr,int}$, that is greater than or equal to 1.25.

Additionally, between the first point 194 and the second point 196, a ratio of the irregularity factor of the second surface 198*b* of the weight member 186, $F_{irr,2}$, to the irregularity factor of the interior surface 184*b* of the main body of the club head 101, $F_{irr,int}$, is preferably within the range of 0.70 to 1.30. More preferably, the ratio of the irregularity factor of the second surface 198*b* of the weight member 186, $F_{irr,2}$, to the irregularity factor of the interior surface 184*b* of the main body of the club head 101, $F_{irr,int}$, is within the range of about 0.85 to about 1.15. Most preferably, the ratio of the irregularity factor of the second surface 198*b* of the weight member 186, $F_{irr,2}$, to the irregularity factor of the interior surface 184*b* of the main body of the club head 101, $F_{irr,int}$, is within the range of about 0.95 to about 1.05.

Referring again to FIG. 14(*f*), in one or more aspects of the present invention, the exterior surface 184*a* of the main body of the club head 101 also generally conforms to interior surface 184*b* of the main body of the club head 101 and generally conforms to the second surface 198*b* of the weight member 186, between the first point 194 and the second point 196. The boundary line 202 passes through the exterior surface 184*a* at a point 248. The boundary line 204 passes through the exterior surface 184*a* at a point 250. The shortest distance between the point 248 and the point 250 corresponds to the nominal length of the exterior surface 184*a*, $L_{nom,ext}$. The actual surface length of the exterior surface 184*a* between the point 248 and the point 250 corresponds to the surface length of the exterior surface 184*a* of the main body of the club head 101, $L_{surf,ext}$. Based on $L_{nom,ext}$ and $L_{surf,ext}$, an irregularity factor of the exterior surface 184*a* of the main body of the club head 101, $F_{irr,ext}$, between the point 248 and the point 250, is defined as follows:

$$F_{irr,ext}=(L_{surf,ext}/L_{nom,ext})^2$$

Preferably, the club head 101 is configured such that, between the point 248 and the point 250, the second surface 198*b* of the weight member 186 comprises an irregularity factor, $F_{irr,2}$, that is greater than or equal to 1.20, the interior surface 184*b* of the main body of the club head 101 comprises an irregularity factor, $F_{irr,int}$, that is greater than or equal to 1.20, and the exterior surface 184*a* of the main body of the club head 101 comprises an irregularity factor, $F_{irr,ext}$, that is greater than or equal to 1.20. More preferably, the second surface 198*b* of the weight member 186 comprises an irregularity factor, $F_{irr,2}$, that is greater than or equal to 1.25, the interior surface 184*b* of the main body of the club head 101 comprises an irregularity factor, $F_{irr,int}$, that is greater than or equal to 1.25, and the exterior surface 184*a* of the main body of the club head 101 comprises an irregularity factor, $F_{irr,ext}$, that is greater than or equal to 1.25.

Additionally, between the point 248 and the point 250, a ratio of $F_{irr,2}$ to $F_{irr,int}$ is preferably within the range of 0.70 to 1.30 and a ratio of $F_{irr,2}$ to $F_{irr,ext}$ is preferably within the range of 0.70 to 1.30. More preferably, the ratio of $F_{irr,2}$ to $F_{irr,int}$ is within the range of about 0.85 to about 1.15, and the ratio of $F_{irr,2}$ to $F_{irr,ext}$ is within the range of 0.85 to 1.15. Most preferably, the ratio of $F_{irr,2}$ to $F_{irr,ext}$ within the range of about 0.95 to about 1.05, and the ratio of $F_{irr,2}$ to $F_{irr,ext}$ is within the range of 0.95 to 1.05.

Referring to FIG. 14(*g*), a gap 197 is located between the first surface 198*a* of the weight member 186 and the interior surface 184*b* of the main body of the club head 101. The gap 197 extends between the interior surface 184*b* of the main body of the club head 101 and the first surface 198*a* of the weight member 186 by an average gap distance, $g_{avg}$. The term "average gap distance", $g_{avg}$, as used herein, denotes an average of a plurality of gap distances $g_0 \ldots g_n$, each measured perpendicular to the imaginary line 192, which incorporates the points 194 and 196, in a vertical plane containing the imaginary line 192, between the first surface 198*a* of the weight member 186 and the interior surface 184*b* of the main body of the club head 101, where the distance $g_0$ is measured along the imaginary line 188, which passes through the point 194, and the gap distances $g_1 \ldots g_n$ are measured along a plurality of lines $l_1 \ldots l_n$, oriented parallel to the line 188 and spaced from each other in increments of 1 mm. The line $l_1$ is spaced a distance of 1 mm from the line 188 and the lines $l_1 \ldots l_n$ include no other lines but all lines parallel to the line 188 between the points 194 and 196, such that no line $l_1 \ldots l_n$ passes through the point 194, but the line $l_n$ may pass through the point 196.

Preferably, between the point 194 and the point 196, the average gap distance, $g_{avg}$, between the first surface 198*a* of the weight member 186 and the interior surface 184*b* is less than or equal to 3 mm. More preferably, between the point 194 and the point 196, the average gap distance, $g_{avg}$, between the first surface 198*a* of the weight member 186 and the interior surface 184*b* is less than or equal to 2 mm. Most preferably, between the point 194 and the point 196, the average gap distance, $g_{avg}$, between the first surface 198*a* of the weight member 186 and the interior surface 184*b* is less than or equal to 1 mm.

Figure 15:
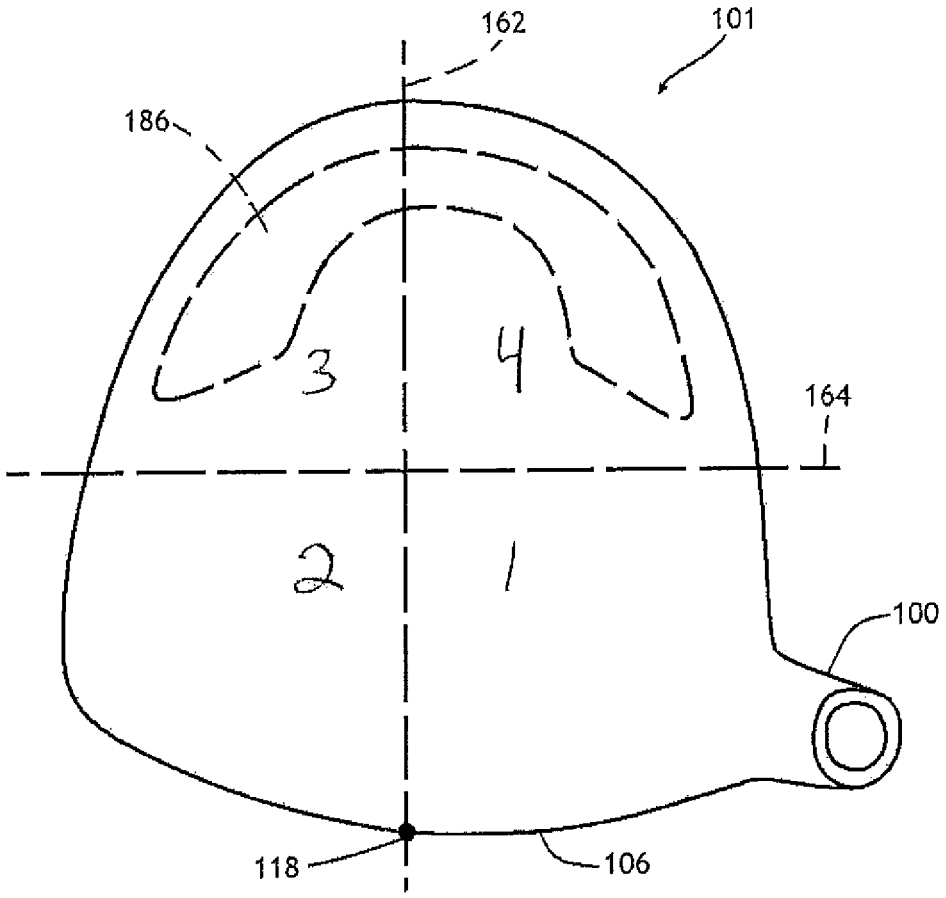
FIG. 15 is a top plan view of an exemplary golf club head according to one or more aspects of the present invention.

Referring to FIG. 15, in one or more aspects of the present invention, a golf club head 101 is shown in the reference position in top plan view. The golf club head 101 includes a weight member 186 secured to the interior surface of the golf club 101. The weight member 186 is located toward the rear of the golf club head 101 and generally conforms to an irregular-contoured portion of the club head 101. The majority of the mass of the weight member 186 is located within the $3^{rd}$ Quadrant and the $4^{th}$ Quadrant, as shown. In one or more aspects of the present invention, greater than or equal to about 75% of the mass of the weight member 186 is located within the $3^{rd}$ Quadrant and the $4^{th}$ Quadrant. In some aspects of the present invention, greater then or equal to about 90% of the mass of the weight member 186 is located within the $3^{rd}$ Quadrant and the $4^{th}$ Quadrant.

Figure 16:
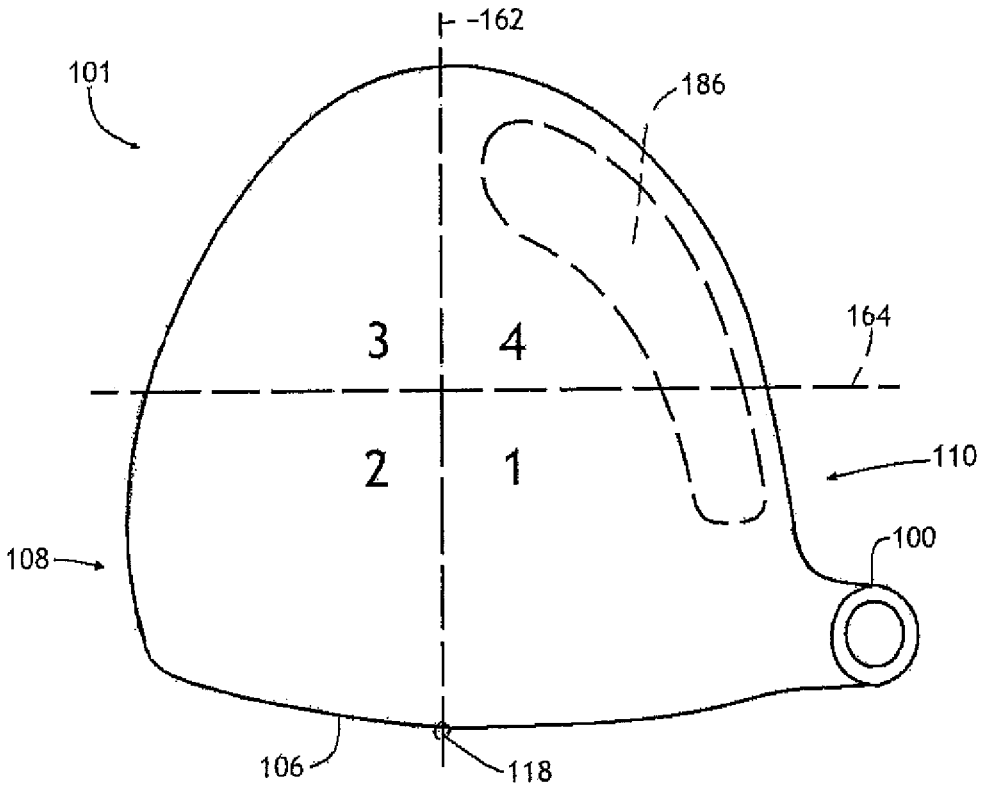
FIG. 16 is top plan view of an exemplary golf club head according to one or more aspects of the present invention.

Referring to FIG. 16, in one or more aspects of the present invention, a golf club head 101 is shown in the reference position. The golf club head 101 includes a heel portion 110, a toe portion 108, and a weight member 186 secured to an irregularly-contoured portion of the interior surface of the golf club head 101. The weight member 186 substantially conforms to the contour of the irregularly-contoured portion of the interior surface of the club head 101, in like manner to the weight member 186 included in the aspect of the present invention shown in FIG. 12(*b*). The weight member 186 is located toward the heel portion 110 of the golf club head 101. Positioning the weight member 186 toward the heel portion 110 results in a desired draw bias. Preferably, the majority of the mass of the weight member 186 is located within the $1^{st}$ Quadrant and the $4^{th}$ Quadrant. More preferably, greater than or equal to about 75% of the mass of the weight insert 186 is located within the $1^{st}$ Quadrant and the $4^{th}$ Quadrant. Most preferably, greater than or equal to about 90% of the mass of the weight member 186 is located within the $1^{st}$ Quadrant and the $4^{th}$ Quadrant.

In alternative aspects of the present invention, a fade bias may be desired. In this case, preferably, the majority of the mass of the weight member 186 is located within the $2^{nd}$ Quadrant and the $3^{rd}$ Quadrant. More preferably, greater than or equal to about 75% of the mass of the weight member 186 is located within the $2^{nd}$ Quadrant and the $3^{rd}$ Quadrant. Most preferably, greater than or equal to about 90% of the mass of the weight member 186 is located within the $2^{nd}$ Quadrant and the $3^{rd}$ Quadrant.

Figure 17:
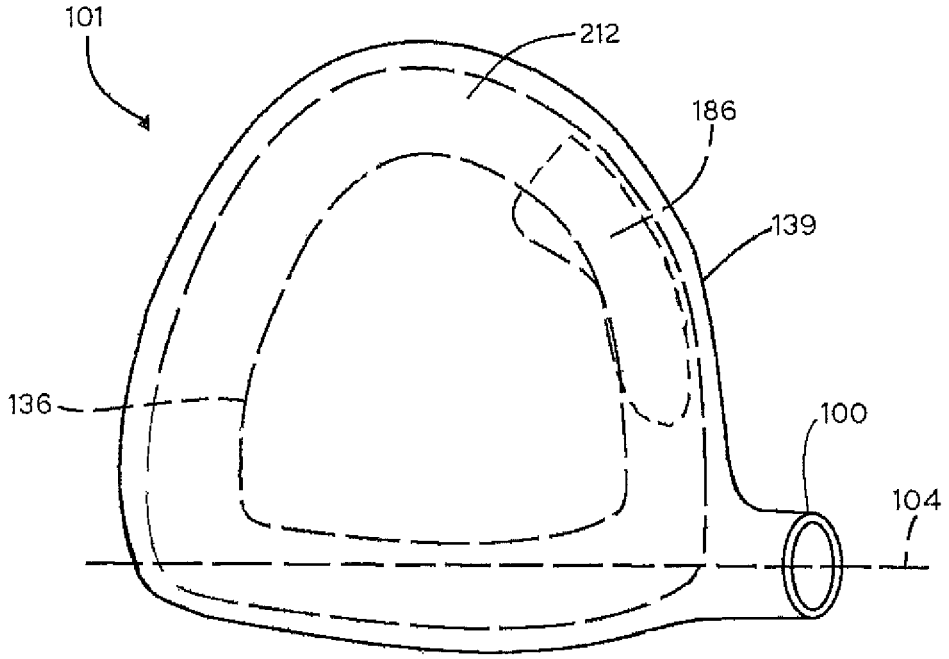
FIG. 17 is a top plan view of an exemplary golf club head according to one or more aspects of the present invention.

Referring to FIG. 17, in one or more aspects of the present invention, a golf club head 101 is shown in the reference position in a top plan view. The golf club head 101 comprises a striking face 106, a hosel portion 100 having a hosel plane 104, a weight member 186, and a peripheral edge 139. The weight member 186 substantially conforms to the contour of an irregularly-contoured portion of the interior surface of the club head 101, in like manner to the weight member 186 included in the aspect of the present invention shown in FIG. 12(*b*). The weight member 186 is located toward the peripheral edge 139 of the golf club head 101, increasing the moment of inertia of the club head 101. Specifically, a majority of the weight member 186 is located in a three-dimensional space 212 bounded by the peripheral edge 139 and an imaginary inner boundary 136 inwardly offset from the peripheral edge 139. Preferably, the club head 101 comprises a primary moment of inertia, $I_{zz}$, greater than or equal to about 3800 g*cm$^2$ and a secondary moment of inertia, $I_{yy}$, greater than or equal to about 2000 g*cm$^2$. More preferably, the primary moment of inertia is greater than or equal to about 4500 g*cm$^2$ and the secondary moment of inertia is greater than or equal to about 2500 g*cm$^2$. Most preferably, the primary moment of inertia of the club head 101 is greater than or equal to about 4800 g*cm$^2$ and the secondary moment of inertia of the club head 101 is greater than or equal to about 2900 g*cm$^2$.

Preferably, the imaginary inner boundary 136 is inwardly offset by a distance of 0.3 times the overall length, $L_o$, of the club head 101. More preferably, the imaginary inner boundary 136 is inwardly offset by a distance of 0.25 times the overall length, $L_o$, of the club head 101. Most preferably, the imaginary inner boundary 136 is inwardly offset by a distance of 0.2 times the overall length, $L_o$, of the club head 101.

Figure 18A:
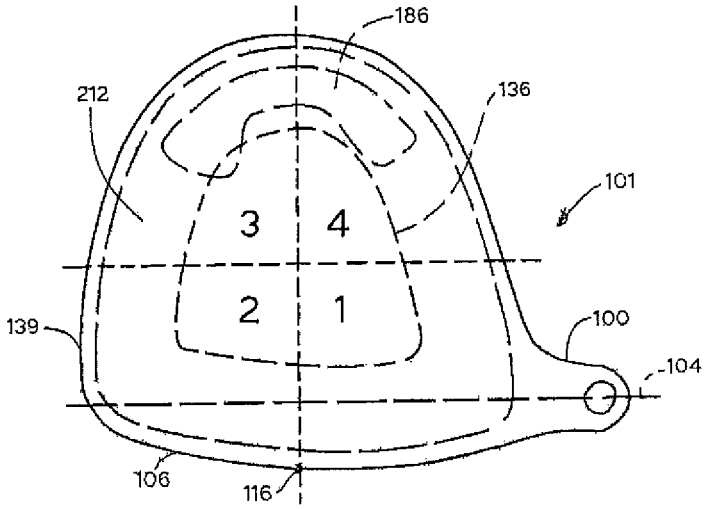
FIG. 18(*a*) is a top plan view of an exemplary golf club head according to one or more aspects of the present invention.
Figure 18B:
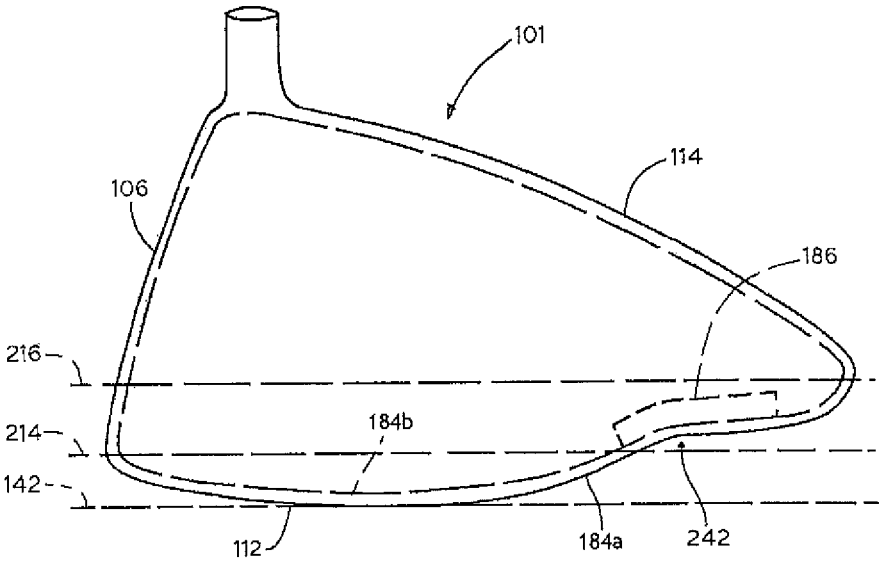

Referring to FIGS. 18(*a*)-18(*b*), in one or more aspects of the present invention, a golf club head 101 includes a top portion 114, a bottom portion 112, a striking face 106, an interior surface 184*b*, an exterior surface 184*a*, and a weight member 186 secured to the interior surface 184*b* of the club head 101. The bottom portion 112 of the club head 101 includes an irregularly-contoured portion 242. The weight member 186 substantially conforms to the contour of an irregularly-contoured portion of the interior surface of the club head 101, in like manner to the weight member 186 included in the aspect of the present invention shown in FIG. 12(*b*).

As shown in FIG. 18(*a*), the majority of the mass of the weight member 186 is within Quadrant 3 and Quadrant 4. Also, the majority of the mass of the weight member 186 is located within a three-dimensional space 212 bounded by the peripheral edge 139 and an imaginary inner boundary 136. The imaginary inner boundary 136 is inwardly offset from the peripheral edge 139 by 0.30 times the overall length of the club head 101, $L_o$.

Referring specifically to FIG. 18(*b*), the weight member 186 is located between a first imaginary horizontal plane 214 and a second imaginary horizontal plane 216. Preferably, the mass of the weight member 186 is greater than or equal to about 8 grams, the volume of the weight member is greater than or equal to about 3 cm$^3$, the first horizontal plane 214 is spaced from the ground plane 142 a distance of 0.03 times $H_o$, the second imaginary horizontal plane 216 is spaced from the ground plane 142 a distance of 0.25 times $H_o$, and a majority of the mass of the weight member 186 is located between the first horizontal plane 214 and the second horizontal plane 216. More preferably, the mass of the weight member 186 is greater than or equal to about 10 grams, the volume of the weight member is greater than or equal to about 3.5 cm$^3$, the first horizontal plane 214 is spaced from the ground plane 142 a distance of 0.04 times $H_o$, the second imaginary horizontal plane 216 is spaced from the ground plane 142 a distance of 0.22 times $H_o$, and greater than 75% of the mass of the weight member 186 is located between the first horizontal plane 214 and the second horizontal plane 216. Most preferably, the mass of the weight member 186 is greater than or equal to about 12 grams, the volume of the weight member is greater than or equal to about 3.75 cm$^3$, the first horizontal plane 214 is spaced from the ground plane 142 a distance of 0.05 times $H_o$, the second imaginary horizontal plane 216 is spaced from the ground plane 142 a distance of 0.19 times $H_o$, and greater than 90% of the mass of the weight member 186 is located between the first horizontal plane 214 and the second horizontal plane 216.

Figure 19A:
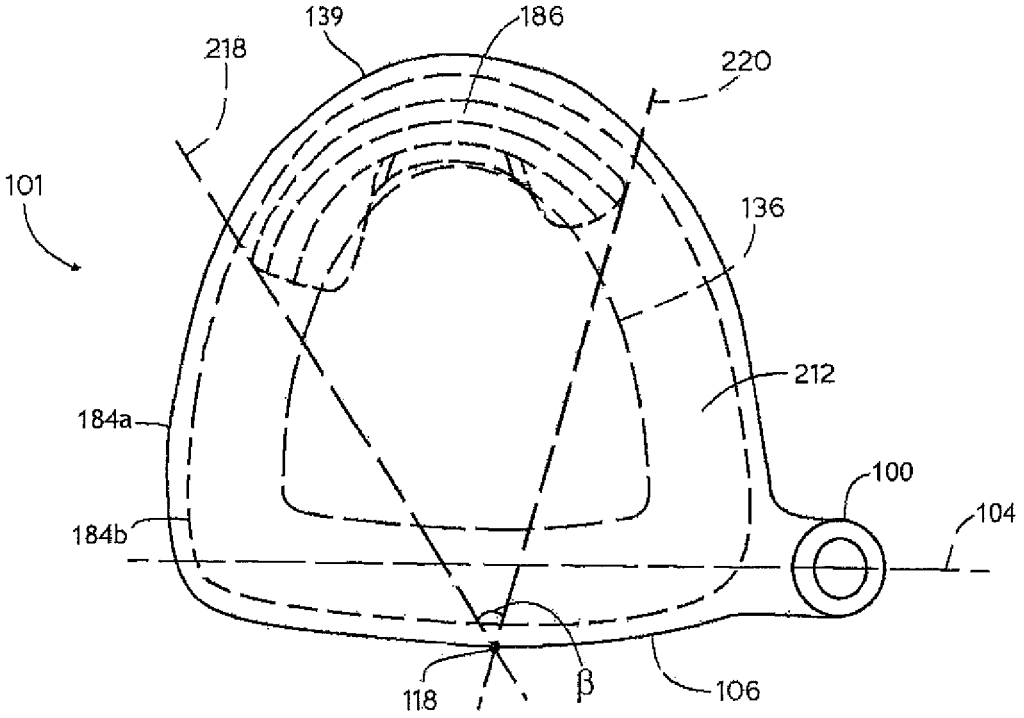
FIG. 19(*a*) is a top plan view of an exemplary golf club head according to one or more aspects of the present invention.
Figure 19B:
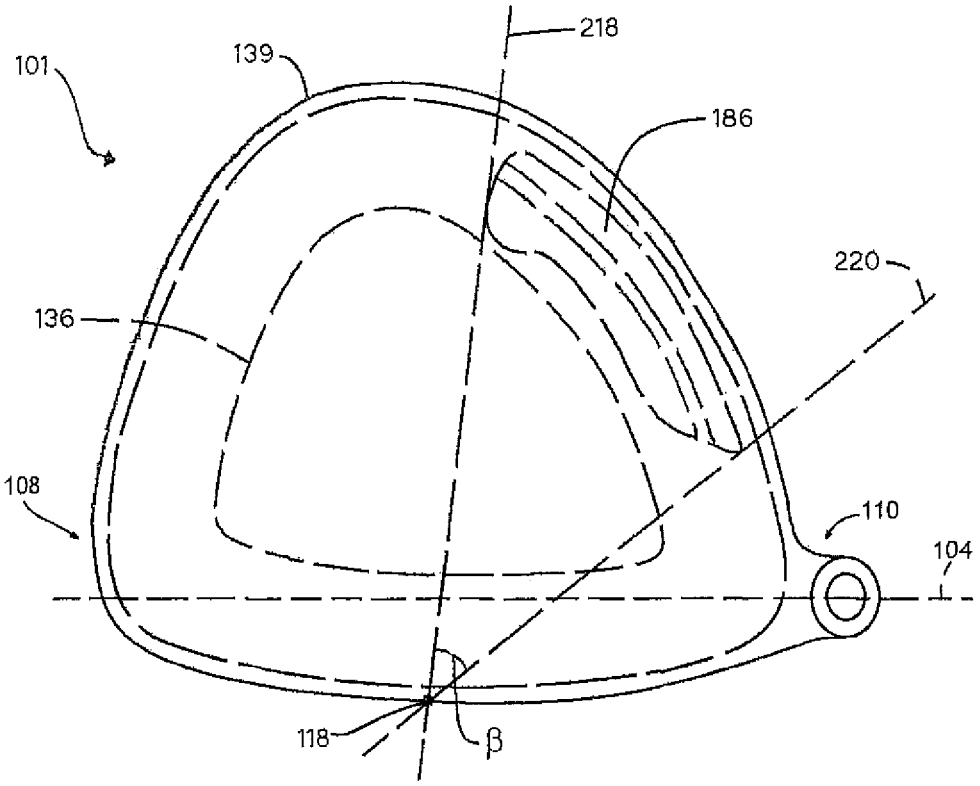

Referring to FIG. 19(*a*), in one or more aspects of the present invention, a golf club head 101 oriented in the reference position is shown in a top plan view. The golf club head 101 includes a striking face 106 having a face center 118, a hosel portion 100, a peripheral edge 139, and a weight member 186 secured to the interior surface 184*b* of the club head 101. The interior surface 184*b* comprises an irregularly-contoured portion. The weight member 186 substantially conforms to the contour of an irregularly-contoured portion of the interior surface of the club head 101, in like manner to the weight member 186 included in the aspect of the present invention shown in FIG. 12(*b*).

The weight member 186 is located toward the peripheral edge 139 of the golf club head 101. Specifically, the majority of the mass of the weight member 186 is located within a three-dimensional space 212 bounded by the peripheral edge 139 and an imaginary inner boundary 136 inwardly offset from the peripheral edge 139 by a distance less than or equal to 0.3 times the overall length, $L_o$, of the club head 101.

A majority of the mass of the weight member 186 is located between a first imaginary vertical plane 218, passing through the face center 118, and a second imaginary vertical plane 220, passing through the face center 118. An angle β is formed between the first imaginary vertical plane 218 and the second imaginary vertical plane 220. Preferably, angle β is greater than or equal to about 20 degrees. More preferably, angle β is greater than or equal to about 30 degrees. Most preferably, angle β is greater than or equal to about 40 degrees.

In some aspects of the present invention, as shown for example in FIG. 19(*b*), the weight member 186 may be secured to the interior surface 184*b* of the golf club head 101 toward the heel portion 110 to effect a draw bias. Alternatively, in one or more aspects of the present invention, the weight member 186 may be secured to the interior surface 184*b* of the golf club head 101 toward the toe portion 108 to effect a fade bias.

In any of the aspects of the present invention discussed above, the weight member 186 may be secured to the interior surface 184*b* by welding, brazing, soldering, chemically adhering, or mechanically fastening. For example, the weight member 186 may be secured to the interior surface 184*b* by a screw means, clamping means, interference fitting, or press-fitting.

Figure 20A:
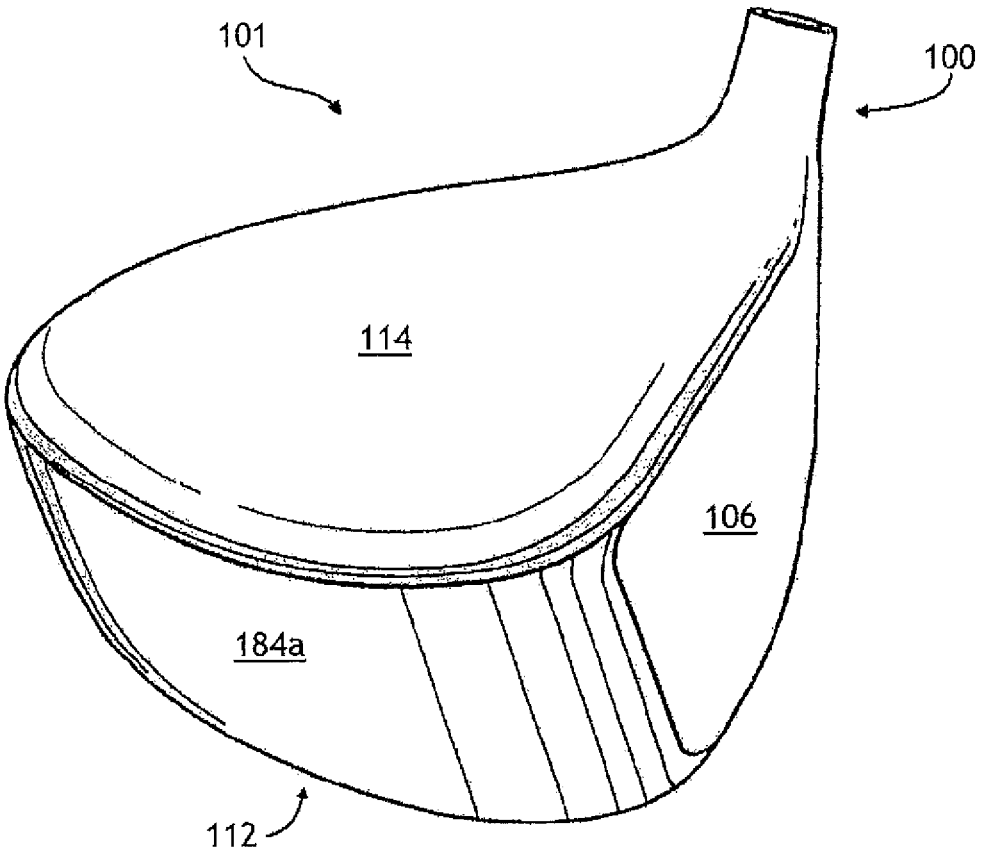
FIG. 20(*a*) is a perspective view of an exemplary golf club head according to one or more aspects of the present invention.
Figure 20B:
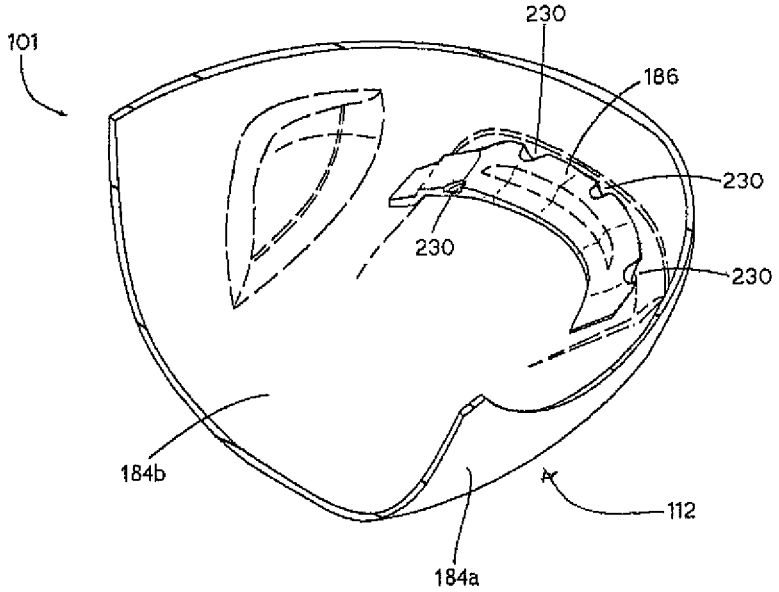
Figure 20C:
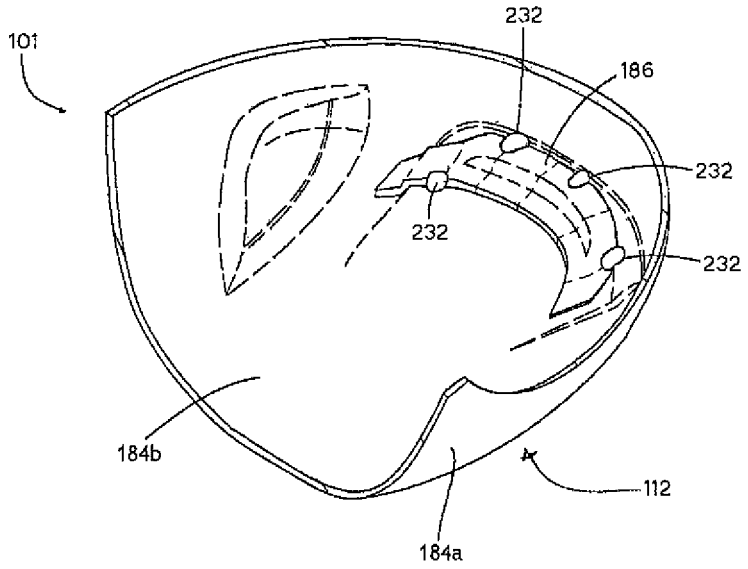

Referring to FIGS. 20(*a*)-20(*c*), in one or more aspects of the present invention, a golf club head 101 comprises a bottom portion 112, a top portion 114, a hosel 100, a striking face 106, an interior surface 184*b*, and an exterior surface 184*a*. A weight member 186 of a first material is secured to, and substantially conforms to the contour of an irregularly-contoured portion of the interior surface of the club head 101, in like manner to the weight member 186 included in the aspect of the present invention shown in FIG. 12(*b*).

As specifically shown in FIG. 20(*b*), a section of the golf club head 101 is shown in an intermediate state of assembly. The weight member 186 comprises a plurality of peripheral recesses 230. In alternative aspects of the present invention, the golf club head 101 comprises only one peripheral recess. The peripheral recesses 230 facilitate placement of the weight member 186 in its intended location. In welding the weight member 186 to the interior surface 184*b*, the peripheral recesses 230 indicate, to the welder, the intended weld locations, ensuring precision and efficient assembly. Additionally, the recess enables a weld area that is lower in height, which further lowers the center of gravity of the club head 101. The peripheral recesses 230 also permit a quicker welding operation and, thus, with less applied heat. As a result, areas of the club head 101 adversely affected by the welding operation are minimized.

In an assembled state, as shown in FIG. 20(*c*), the peripheral recesses 230 are at least partially filled with a filler 232. In some aspects of the present invention, the filler 232 comprises a material similar to the composition of the main body of the club head 101 or of the weight member 186. In other aspects of the present invention, the filler 232 comprises a material different from the composition of the main body of the club head 101. In some aspects of the present invention, the first material comprises titanium, tungsten, stainless steel, aluminum, or a polymer. In some aspects of the present invention, in an assembled state, the peripheral recesses 230 are only partially filled with filler.

Figure 21A:
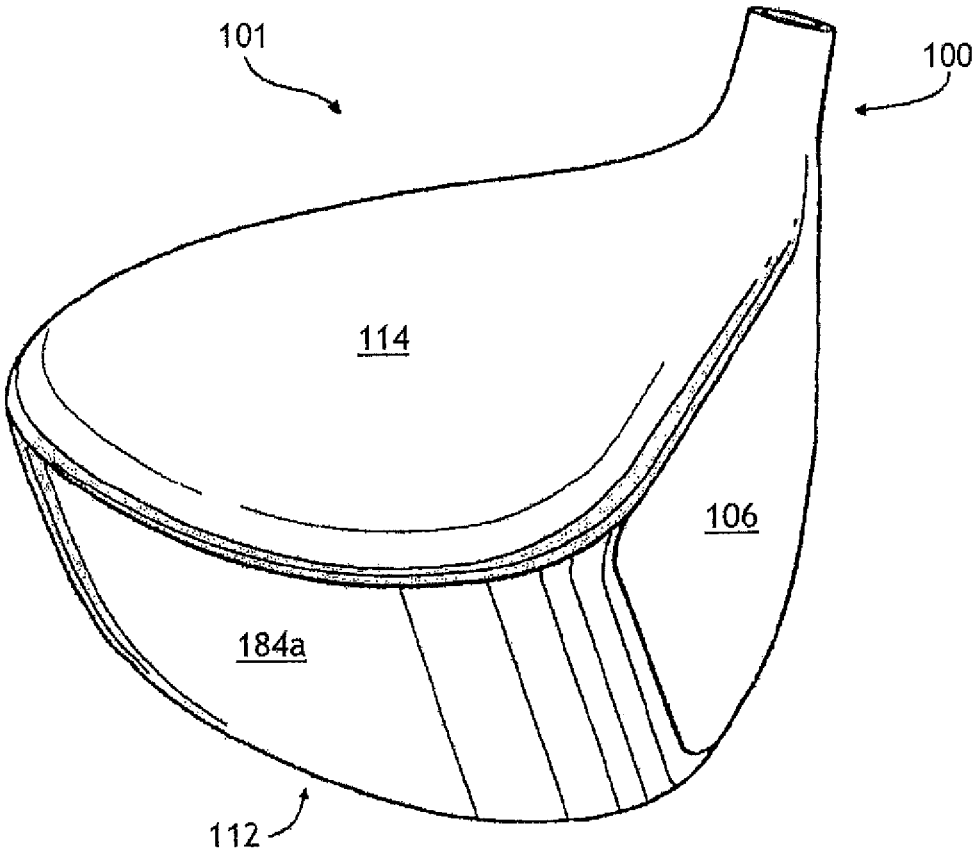
FIG. 21(*a*) is a perspective view of an exemplary golf club head according to one or more aspects of the present invention.
Figure 21B:
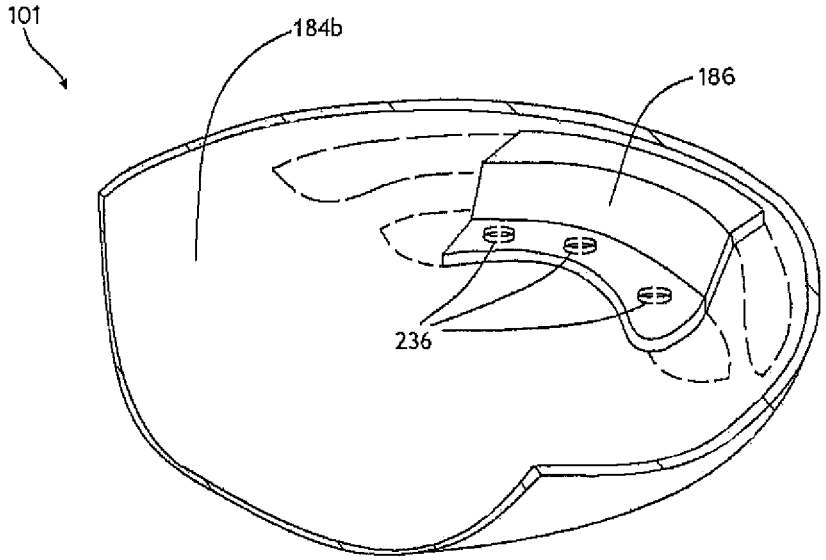
Figure 21C:
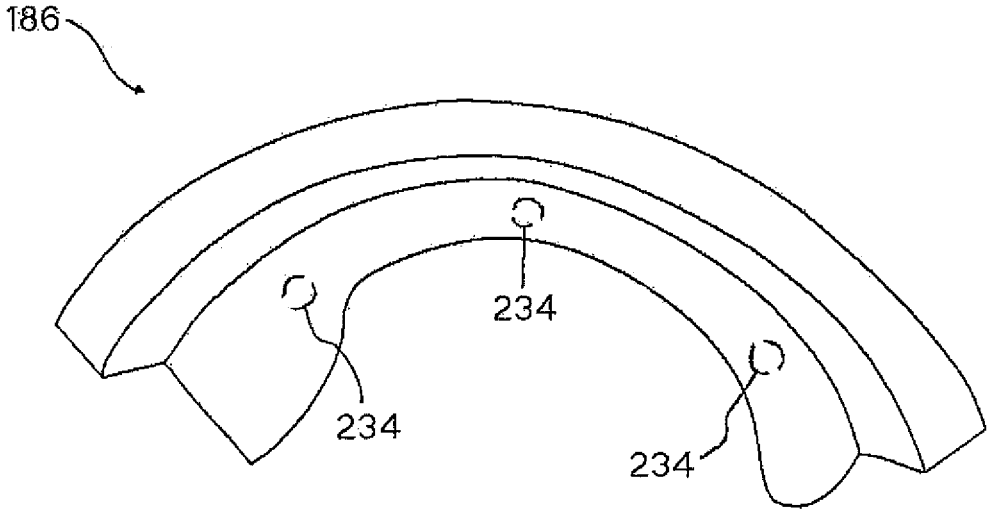

Referring to FIGS. 21(*a*)-21(*c*), in one or more aspects of the present invention, a golf club head 101 comprises a top portion 114, a bottom portion 112, a hosel 100, a striking face 106, an interior surface 184*b*, an exterior surface 184*a*, and a weight member 186. The weight member 186 is secured to an irregularly-contoured portion of the interior surface 184*b* of the golf club head 101. The weight member 186 substantially conforms to the contour of the irregularly-contoured portion of the interior surface 184*b* of the club head 101, in like manner to the weight member 186 included in the aspect of the present invention shown in FIG. 12(*b*)

As shown in FIGS. 21(*b*) and 21(*c*), the golf club head 101 further comprises position locators 236 that comprise protrusions extending from the interior surface 184*b*. The weight member 186 comprises position locators 234 that are complementary in form to the locator protrusions 236. Specifically, the position locators 234 of the weight member 186 comprise recesses configured to engage with the position locators 236 extending from the interior surface 184*b* of the club head 101.

In an assembled state, as shown in FIG. 21(*b*), the position locators 236 are at least partially fitted into the position locators 234. In this manner, the weight member 186 may be positioned on the interior surface 184*b* more quickly and more accurately. In alternative aspects of the present invention, the interior surface 184*b* of the golf club head 101 comprises position locators comprising recesses and the weight member comprises position locators comprising protrusions complementary to the recesses. In some aspects of the present invention, the weight member 186 and the interior surface 184*b* comprise position locators having other complementary configurations, e.g., a tongue and groove configuration.

Figure 22:
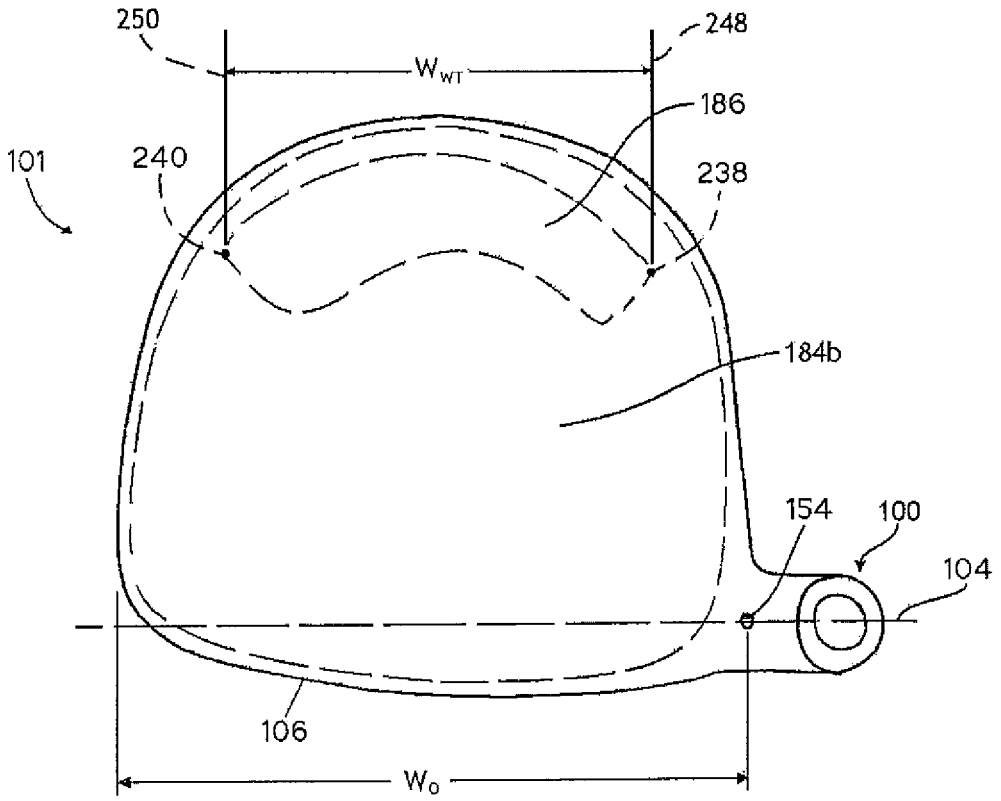
FIG. 22 is a top plan view of an exemplary golf club head according to one or more aspects of the present invention.

Referring to FIG. 22, in one or more aspects of the present invention, a golf club head 101 is shown in the reference position. The golf club head 101 includes an overall width, $W_o$, a striking face 106, an interior surface 184*b* having an irregularly-contoured portion, a hosel 100 having a hosel plane 104, and a weight member 186 secured to the interior surface 184*b* of the golf club head 101. The weight member 186 substantially conforms to the contour of the irregularly-contoured portion of the interior surface 184*b* of the club head 101, in like manner to the weight member 186 included in the aspect of the present invention shown in FIG. 12(*b*).

The weight member 168 further includes a heelward-most point 238 and a toeward-most point 240. A first imaginary vertical plane 248 is orthogonal to the hosel plane 104 and passes through the heelward-most point 238. A second imaginary vertical plane 250 is orthogonal to the hosel plane 104 and passes through the toeward-most point 240. The shortest distance between the first imaginary vertical plane 248 and the second imaginary vertical plane 250 corresponds to the width of the weight member, $W_{wt}$.

Preferably, the weight member 186 has a mass greater than or equal to about 8 g, a volume greater than or equal to about 2.75 $cm^3$ and a ratio of $W_{wt}$ to $W_o$ that is greater than or equal to 0.3. More preferably, the weight member 186 has a mass greater than or equal to about 12 g, a volume greater than or equal to about 3.75 $cm^3$ and a ratio of $W_{wt}$ to $W_o$ that is greater than or equal to 0.4. Most preferably, the weight member 186 has a mass greater than or equal to about 15 g, a volume greater than or equal to about 3.75 $cm^3$ and a ratio of $W_{wt}$ to $W_o$ that is greater than or equal to 0.5.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

We claim:

1. A golf club head oriented in a reference position and comprising:

a main body comprising:

a heel, a toe, a top portion, and a bottom portion;

a striking face having a face center;

a forward-most extent, and a rearward-most extent;

an interior surface, and an exterior surface;

a hosel;

a peripheral edge;

an overall club-head width measured in a heel-toe direction;

an overall club-head length measured in a forward-rearward direction; and a geometric center; and a discrete weight member coupled to the interior surface of the main body, the weight member comprising a first surface that is proximate the interior surface of the main body, and a second surface that is distal the interior surface of the main body, a majority of the mass of the weight member being located in a three-dimensional space, bounded, in a top plan view, between the peripheral edge and an imaginary inner boundary inwardly offset from the peripheral edge by a distance of 0.3 times the overall club head length, wherein, in an imaginary vertical plane that passes through the weight member:

the interior surface of the main body comprises a first point and a second point;

an imaginary line passes through the first point and the second point;

a first imaginary boundary line perpendicular to the imaginary line and passing through the first point passes through the weight member;

a second imaginary boundary line perpendicular to the imaginary line and passing through the second point passes through the weight member;

between the first point and the second point, the interior surface of the main body comprises an irregularity factor of at least 1.2; and between the first point and the second point, the weight member comprises a distribution factor of at most 1.0 and a conformity factor of at most 0.07.

2. The golf club head of claim 1, wherein, between the first point and the second point, the golf club head further comprises an average gap distance between the weight member and the interior surface of the main body, the gap distance being at most about 1.0 millimeter.

3. The golf club head of claim 1, wherein the distribution factor of the weight member is at least 0.1.

4. The golf club head of claim 1, wherein the conformity factor of the weight member is at most 0.05, and the distribution factor of the weight member is at least 0.25.

5. The golf club head of claim 1, wherein, in the imaginary vertical plane:

the weight member further comprises a first lateral endpoint and a second lateral endpoint; and the first imaginary boundary line passes through the first lateral endpoint and the second imaginary boundary line passes through the second lateral endpoint.

6. The golf club head of claim 1, wherein the irregularity factor of the interior surface of the main body is at least 1.25.

7. The golf club head of claim 1, wherein the irregularity factor of the interior surface of the main body is at least 1.30.

8. The golf club head of claim 1, wherein the weight member further comprises a weight-member width in the heel-toe direction wherein a ratio of the weight-member width to the overall club-head width is at least 0.3.

9. The golf club head of claim 1, wherein:

the weight member is coupled to the bottom portion of the main body; and the bottom portion of the main body comprises a material having an elongation of at least about 10%.

10. The golf club head of claim 1, wherein the weight member is secured to the main body by an attachment method chosen from the group consisting of welding, brazing, adhesive bonding, and mechanical fastening.

11. The golf club head of claim 1, further comprising a total club-head mass wherein a ratio of the mass of the weight member to the total club-head mass is at least 0.04.

12. The golf club head of claim 1, further comprising a total club-head mass between about 150 g and about 225 g.

13. The golf club head of claim 1, wherein the volume of the golf club head is at least about 250 cm3.

14. The golf club head of claim 1, wherein the weight member further comprises a peripheral recess.

15. The golf club head of claim 14, wherein the weight member comprises a plurality of peripheral recesses.

16. The golf club head of claim 14, wherein the weight member comprises a first material and the peripheral recess is at least partially filled with a second material that is different from the first material.

17. The golf club head of claim 16, wherein the second material joins the weight member to the interior surface of the main body.

18. The golf club head of claim 1, wherein the first surface of the weight member comprises a first position locator and the interior surface of the main body comprises a second position locator, the first and second position locators being complementary to each other.

19. The golf club head of claim 1, wherein the weight member comprises a material chosen from the group consisting of metals and polymers.

20. The golf club head of claim 1, further comprising a primary natural frequency between about 3000 and about 4500 Hz.

21. The golf club head of claim 1, further comprising a moment of inertia, Izz, of at least about 4000 g*cm2.

22. The golf club head of claim 1, further comprising a moment of inertia, Izz, of at least about 4500 g*cm2.

23. The golf club head of claim 1, further comprising an overall height, wherein a majority of the mass of the weight member is between a first imaginary horizontal plane that is spaced from the ground plane by a distance of 0.03 times the overall height of the golf club head and a second imaginary horizontal plane that is spaced from the ground plane by a distance of 0.25 times the overall height of the golf club head.

24. The golf club head of claim 23, wherein at least 75% of the mass of the weight member is between the first imaginary horizontal plane and the second imaginary horizontal plane.

25. The golf club head of claim 1, wherein a cross-section of the weight member within the imaginary vertical plane transitions from convex to concave.

26. A golf club head oriented in a reference position and comprising:

a main body comprising:

a heel, a toe, a top portion, and a bottom portion;

a striking face having a face center;

a forward-most extent, and a rearward-most extent;

an interior surface, and an exterior surface;

a peripheral edge;

a hosel;

an overall club-head length measured in a forward-rearward direction; and an overall club-head width measured in a heel-toe direction; and a discrete weight member coupled to the interior surface of the main body, the weight member having a first surface proximate the interior surface of the main body, and a second surface distal the interior surface of the main body, a majority of the mass of the weight member being located in a three-dimensional space, bounded, in a top plan view, between the peripheral edge and an imaginary inner boundary inwardly offset from the peripheral edge by a distance of 0.3 times the overall club head length, wherein, in an imaginary vertical plane that passes through the weight member:

the interior surface of the main body comprises a first point and a second point;

an imaginary line passes through the first point and the second point;

a first imaginary boundary line perpendicular to the imaginary line and passing through the first point passes through the weight member;

a second imaginary boundary line perpendicular to the imaginary line and passing through the second point passes through the weight member;

between the first point and the second point, the weight member comprises a distribution factor of at most 1.0;

between the first point and the second point, the second surface of the weight member comprises a second-surface irregularity factor of at least 1.20;

between the first point and the second point, the interior surface of the main body comprises an interior-surface irregularity factor of at least 1.20; and an intercomponent ratio of the second-surface irregularity factor to the interior-surface irregularity factor is between 0.70 and 1.3.

27. The golf club head of claim 26, wherein the intercomponent ratio of the second-surface irregularity factor to the interior surface irregularity factor is between 0.85 and 1.15.

28. The golf club head of claim 26, wherein the distribution factor of the weight member is between 0.25 and 1.0.

29. The golf club head of claim 26, wherein the exterior surface of the main body comprises an exterior-surface irregularity factor of at least 1.20, and an intercomponent ratio of the interior-surface irregularity factor to the exterior-surface irregularity factor is between 0.70 and 1.3.

30. The golf club head of claim 26, wherein, between the first point and the second point, the golf club head further comprises an average gap distance, measured perpendicular to the imaginary line and between the first surface of the weight member and the interior surface of the main body, of at most 1.0 millimeter.

31. The golf club head of claim 26, wherein a cross-section of the weight member within the imaginary vertical plane transitions from convex to concave.

* * * * *